US009479854B2

(12) United States Patent
Loeppert et al.

(10) Patent No.: US 9,479,854 B2
(45) Date of Patent: Oct. 25, 2016

(54) MICROPHONE ASSEMBLY WITH BARRIER TO PREVENT CONTAMINANT INFILTRATION

(71) Applicant: Knowles Electronics, LLC, Itasca, IL (US)

(72) Inventors: Peter V. Loeppert, Durand, IL (US); Ryan M. McCall, San Jose, CA (US); Daniel Giesecke, West Chicago, IL (US); Sandra F. Vos, East Dundee, IL (US); John B. Szczech, Schaumburg, IL (US); Sung Bok Lee, Chicago, IL (US); Peter Van Kessel, Downers Grove, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 14/755,673

(22) Filed: Jun. 30, 2015

(65) Prior Publication Data

US 2015/0304753 A1 Oct. 22, 2015

Related U.S. Application Data

(63) Continuation of application No. 13/960,392, filed on Aug. 6, 2013, now Pat. No. 9,078,063.

(60) Provisional application No. 61/681,685, filed on Aug. 10, 2012.

(51) Int. Cl.

| | |
|---|---|
| ***H04R 9/08*** | (2006.01) |
| ***H04R 1/08*** | (2006.01) |
| ***H04R 1/04*** | (2006.01) |

(52) U.S. Cl.
CPC *H04R 1/08* (2013.01); *H04R 1/04* (2013.01); *H04R 1/086* (2013.01); *H04R 2201/003* (2013.01)

(58) Field of Classification Search
CPC ..... H04R 1/08; H04R 1/086; H04R 1/04; H04R 2201/003
See application file for complete search history.

(56) References Cited

U.S. PATENT DOCUMENTS

| | | | |
|---|---|---|---|
| 7,151,057 | B2 | 12/2006 | Nam et al. |
| 7,190,038 | B2 | 3/2007 | Dehe et al. |
| 7,202,552 | B2 | 4/2007 | Zhe et al. |

(Continued)

FOREIGN PATENT DOCUMENTS

| | | | |
|---|---|---|---|
| JP | 2004-120764 | A | 4/2004 |
| JP | 2008-295026 | A | 12/2008 |

(Continued)

OTHER PUBLICATIONS

English-language machine translation of JP 2010-268412, Panasonic Corp (Nov. 25, 2010).

(Continued)

*Primary Examiner* — Tuan D Nguyen
(74) *Attorney, Agent, or Firm* — Foley & Lardner LLP

(57) ABSTRACT

A micro-electro-mechanical system (MEMS) microphone includes a rectangular substrate with a rigid base layer, a first metal layer, a second metal layer, one or more electrical pathways, an acoustic port, and a patterned flexible printed circuit board material. The MEMS microphone also includes a MEMS microphone die and a solid single-piece rectangular cover.

20 Claims, 35 Drawing Sheets

(56) References Cited

U.S. PATENT DOCUMENTS

| | | | | |
|---|---|---|---|---|
| 7,473,572 | B2 | 1/2009 | Dehe et al. | |
| 7,763,488 | B2 | 7/2010 | Goodelle et al. | |
| 7,781,249 | B2 | 8/2010 | Laming et al. | |
| 7,795,695 | B2 | 9/2010 | Weigold et al. | |
| 7,825,484 | B2 | 11/2010 | Martin et al. | |
| 7,829,961 | B2 | 11/2010 | Hsiao | |
| 7,856,804 | B2 | 12/2010 | Laming et al. | |
| 7,903,831 | B2 | 3/2011 | Song | |
| 8,783,113 | B2 | 7/2014 | Robert et al. | |
| 2005/0194685 | A1 | 9/2005 | Weiblen et al. | |
| 2005/0207605 | A1 | 9/2005 | Dehe et al. | |
| 2006/0116180 | A1 | 6/2006 | Minervini | |
| 2006/0177085 | A1* | 8/2006 | Izuchi | H04R 19/04 381/369 |
| 2007/0278501 | A1 | 12/2007 | MacPherson et al. | |
| 2008/0175425 | A1 | 7/2008 | Roberts et al. | |
| 2008/0267431 | A1 | 10/2008 | Leidl et al. | |
| 2008/0279407 | A1 | 11/2008 | Pahl | |
| 2008/0283942 | A1 | 11/2008 | Huang et al. | |
| 2009/0001553 | A1 | 1/2009 | Pahl et al. | |
| 2009/0180655 | A1 | 7/2009 | Tien et al. | |
| 2010/0046780 | A1 | 2/2010 | Song | |
| 2010/0052082 | A1 | 3/2010 | Lee et al. | |
| 2010/0128914 | A1 | 5/2010 | Khenkin | |
| 2010/0183181 | A1 | 7/2010 | Wang | |
| 2010/0246877 | A1 | 9/2010 | Wang et al. | |
| 2010/0264499 | A1* | 10/2010 | Goodelle | B81C 1/00333 257/416 |
| 2010/0290644 | A1 | 11/2010 | Wu et al. | |
| 2010/0322443 | A1 | 12/2010 | Wu et al. | |
| 2010/0322451 | A1 | 12/2010 | Wu et al. | |
| 2011/0013787 | A1 | 1/2011 | Chang | |
| 2011/0075875 | A1 | 3/2011 | Wu et al. | |
| 2011/0254111 | A1 | 10/2011 | LeClair et al. | |
| 2012/0237073 | A1* | 9/2012 | Goida | H04R 1/02 381/361 |

FOREIGN PATENT DOCUMENTS

| | | | |
|---|---|---|---|
| JP | 2009-501442 | A | 1/2009 |
| JP | 2009-055198 | A | 3/2009 |
| JP | 2009-540566 | A | 11/2009 |
| JP | 2010-268412 | A | 11/2010 |
| JP | 2012-027026 | A | 2/2012 |

OTHER PUBLICATIONS

English-language machine translation of JP 2009-501442, Silicon Matrix Pte. Ltd (Jan. 15, 2009).

English-language machine translation of JP 2008-295026, Kyocera Corp (Dec. 4, 2008).

* cited by examiner

MICROPHONE ASSEMBLY WITH BARRIER TO PREVENT CONTAMINANT INFILTRATION

CROSS REFERENCE TO RELATED APPLICATIONS

This application is a continuation of prior U.S. application Ser. No. 13/960,392 filed Aug. 6, 2013 entitled "Microphone Assembly with Barrier to Prevent Contaminant Infiltration," which claims benefit under 35 U.S.C. §119 (e) to U.S. Provisional Application No. 61/681,685 filed Aug. 10, 2012 entitled "Microphone Assembly with Barrier to Prevent Contaminant Infiltration," the content of both of which are herein incorporated herein by reference in their entireties.

TECHNICAL FIELD

This application relates to acoustic devices and, more specifically, to barriers that prevent intrusion of contaminants within these devices.

BACKGROUND OF THE INVENTION

MicroElectroMechanical System (MEMS) assemblies include microphones and speakers to mention two examples. These MEMS devices may be used in diverse applications such as within hearing aids and cellular phones.

In the case of a MEMS microphone, acoustic energy typically enters through a sound port in the assembly, vibrates a diaphragm and this action creates a corresponding change in electrical potential (voltage) between the diaphragm and a back plate disposed near the diaphragm. This voltage represents the acoustic energy that has been received. Typically, the voltage signal is then transmitted to an electric circuit (e.g., an integrated circuit such as an application specific integrated circuit (ASIC)). Further processing of the signal may be performed on the electrical circuit. For instance, amplification or filtering functions may be performed on the voltage signal by the integrated circuit.

As mentioned, sound typically enters the assembly through an opening or port. When a port is used, this opening also allows other unwanted or undesirable items to enter the port. For example, various types of contaminants (e.g., solder, flux, dust, and spit, to mention a few possible examples) may enter through the port. Once these items enter the assembly, they may damage the internal components of the assembly such as the MEMS device and the integrated circuit.

Previous systems have sometimes deployed particulate filters that prevent some types of debris from entering an assembly. Unfortunately, these filters tend to adversely impact the operation of the microphone. For instance, the performance of the microphone sometimes becomes significantly degraded when using these previous approaches. Microphone customers often elect to not use such microphones in their applications because of the degraded performance.

BRIEF DESCRIPTION OF THE DRAWINGS

For a more complete understanding of the disclosure, reference should be made to the following detailed description and accompanying drawings wherein.

Figure 1:
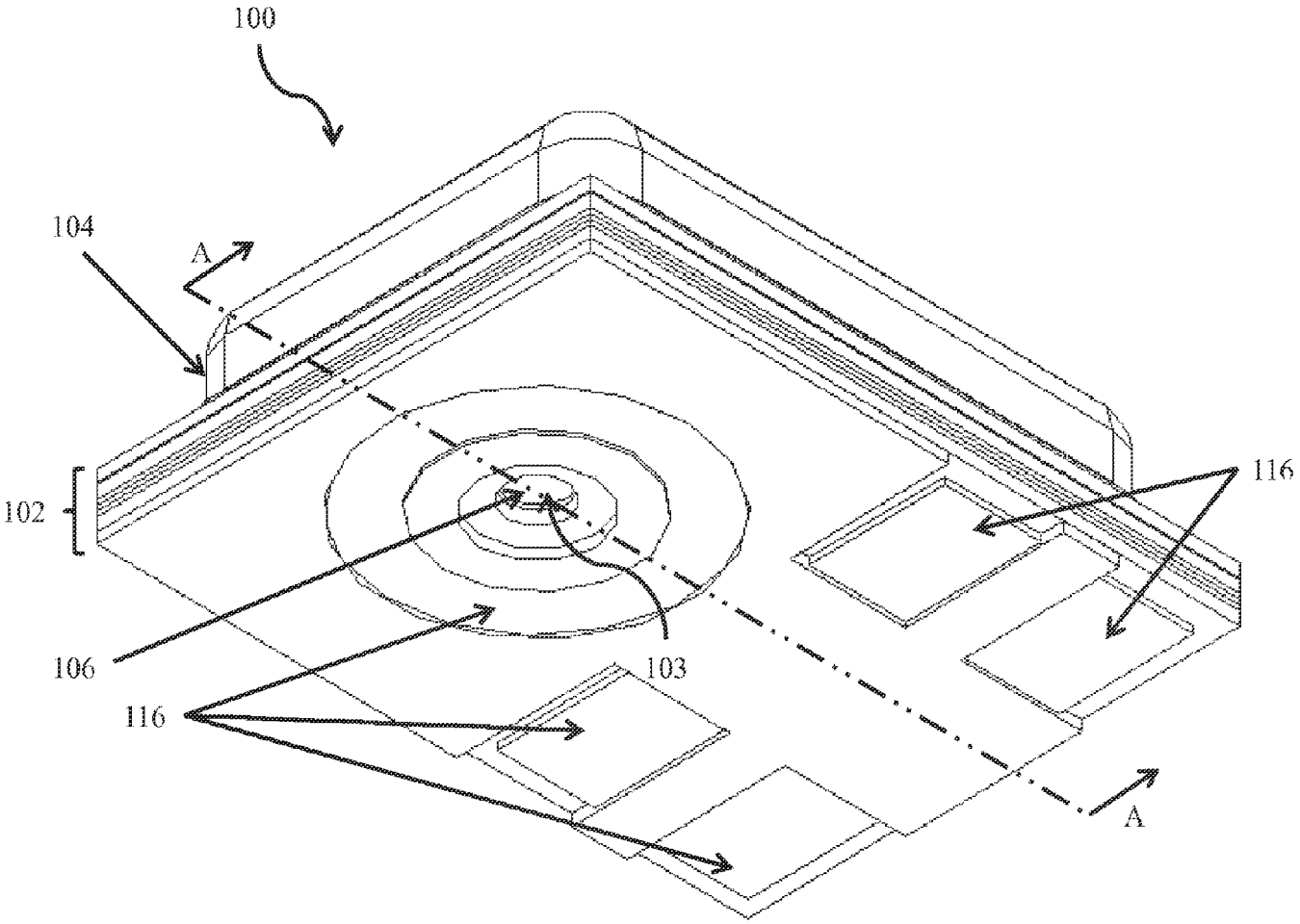
FIG. 1 is a perspective diagram of a MEMS assembly according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not necessarily required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Acoustic assemblies (e.g., microphone assemblies) are provided wherein environmental barriers are deployed to reduce or eliminate the infiltration of environmental contaminants into the interior of these assemblies. In this respect, the structures provided herein significantly reduce or eliminate the intrusion of harmful environmental contaminants (e.g., fluids and particulates) from the exterior of the assembly to the interior of the assembly, can be easily and economically manufactured, and do not significantly degrade microphone performance in terms of sensitivity (and in some cases improve some aspects of the performance of the microphone, for example, flat sensitivity response in the audio band).

In some of these embodiments, a microphone assembly includes a base and a cover that is connected to the base. An interior cavity is formed between the cover and the base in which is disposed a MEMS apparatus. Either the base or the cover has a port extending therethrough. A barrier is embedded in the base or the cover so as to extend across the port. The barrier prevents at least some contaminants from entering the interior of the assembly and damaging the components disposed therein such as the MEMS apparatus. In some aspects, the embedded barrier is a porous membrane, filter or mesh and in other aspects the barrier is a patterned flex circuit with openings disposed therethrough.

In still others of these embodiments, a microphone assembly includes a base and a cover. An interior cavity is formed between the cover and the base in which is disposed a MEMS apparatus. A second cavity is formed within the base. A first opening or hole in the base allows external sound to enter the second cavity from the exterior of the assembly and a second opening or hole in the base allows the sound to move from the second cavity to the MEMS apparatus that is disposed in the interior cavity of the assembly. The openings and the second cavity in the base form a baffle structure that is effective in preventing at least some contaminants from entering the interior of the assembly using an indirect path.

In yet others of these embodiments, a microphone assembly includes a base and a cover. An interior cavity is formed between the cover and the base in which is disposed a MEMS apparatus. A port extends through the base and the MEMS apparatus is disposed in the interior of the assembly and over the port. A barrier is also disposed over the port. In some aspects, the barrier includes a tunnel that forms a tortuous (e.g., twisting) path for sound entering the port to traverse before the sound is received at the MEMS apparatus. In other aspects, the barrier is constructed of a porous material and sound proceeds through the barrier to be received at the MEMS apparatus. However, the tortuous path is effective in preventing at least some contaminants from entering the interior of the assembly.

In yet others of these embodiments, a microphone assembly includes a base and a cover. An interior cavity is formed between the cover and the base in which is disposed a MEMS apparatus. A MEMS apparatus is disposed in the interior of the assembly within the cavity. In the assembly, the port hole is not a completely open hole. Instead, sound enters through portions of the lid. In one aspect, the lid includes a partially fused area through which sound enters the interior of the assembly and a highly fused area where sound does not enter the assembly. The non-fused portion of the lid is effective for preventing at least some contaminants from entering the interior of the assembly.

In still others of these embodiments, a microphone assembly includes a base and a cover. An interior cavity is formed between the cover and the base in which is disposed a MEMS apparatus. A MEMS apparatus is disposed in the interior of the assembly within the cavity and a port is formed in the assembly. The lid is formed with a metal mesh surrounded by an optional outer material thereby making the entire metal mesh lid the acoustic port. In cases, were an outer material is used, portions of the cover can be removed to create a port that exposes the metal mesh. Consequently, sound is allowed to enter the port, traverse through the mesh, and be received at the MEMS apparatus. At the same time, the metal mesh is effective to prevent at least some contaminants from entering the interior of the assembly while maintaining a significant degree of electromagnetic immunity.

In yet others of these embodiments, a microphone assembly includes a base and a cover. A port extends through the base and a MEMS apparatus is disposed at the base in the interior of the assembly and over the port. A membrane or passivation layer is attached to and extends across the base and over the port. The membrane or passivation layer includes openings through which expose metal solder pads on the base, effectively preventing solder bridging between the pads during reflow. The membrane that extends across the base (and port) is effective for preventing at least some contaminants from entering the interior of the assembly but at the same time allows sound to pass therethrough.

As used herein, "contaminants" refers to any type or form of undesirable material that could enter an assembly from the environment external to the assembly. For example, contaminants may include dust, dirt, water, vapor, to mention only a few examples.

Figure 2:
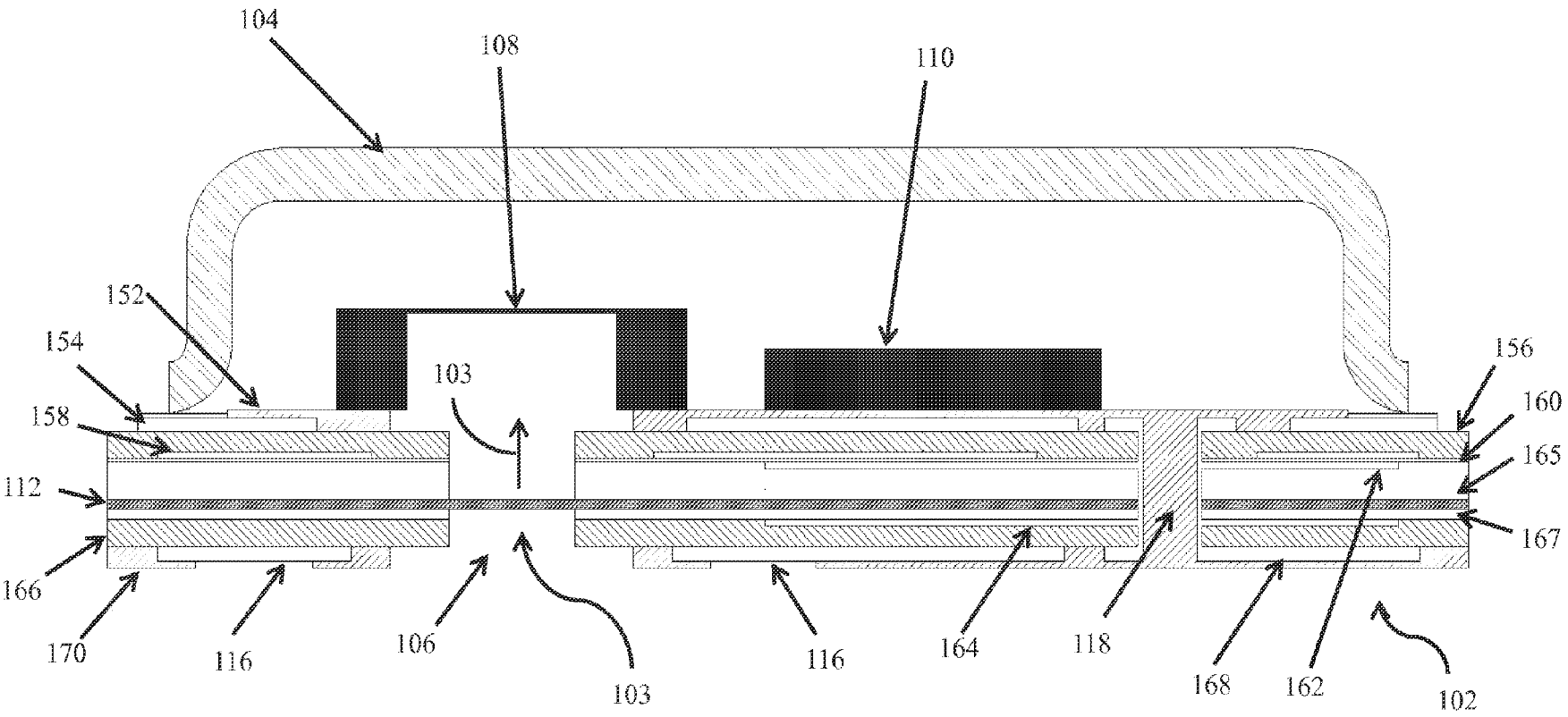
FIG. 2 is a cross-sectional view of the MEMS assembly of FIG. 1 taken along lines A-A according to various embodiments of the present invention.

Referring now to FIGS. 1-2, one example of an embedded barrier deployed in a microphone assembly 100 is described. The assembly 100 includes a base 102, a lid 104, a port 106, a Microelectromechanical System (MEMS) apparatus 108, and an integrated circuit 110. A barrier 112 is embedded in the base 102. Although shown as being embedded in the base 102 (making the assembly 100 a bottom port device), it will be appreciated that the port 106 can be moved to the lid 104 (thereby making the device a top port device) and the barrier 112 can be embedded in the lid 104.

Generally speaking and as described elsewhere herein, each of the lid 104 and base 102 are formed of one or more layers of materials. For example, these components may be constructed of one or more FR-4 boards, and may have various conductive and insulating layers arranged around these boards.

The port 106 extends through the base 102 and the MEMS apparatus 108 is disposed over the port. Conductive traces (not shown) couple the output of the integrated circuit 110 to conductive pads 116 on the base. A customer can make an electrical connection with the pads 116 for further processing of the signal that is received from the integrated circuit 110. Multiple vias, such as via 118, extend through the base 102 and allow electrical connections to be made between the integrated circuit 110 and the conductive pads 116.

The MEMS apparatus 108 receives acoustic energy which is transduced into electrical energy. In that respect, the MEMS apparatus 108 may include a diaphragm and a back plate. Acoustic energy causes movement of the diaphragm and this varies the voltage between the diaphragm and the back plate. The electrical signal that is produced represents the acoustic energy that has been received by the MEMS apparatus 108. The MEMS apparatus 108 is attached to the base by adhesive or any other appropriate fastening mechanism or approach.

The integrated circuit 110 is any kind of integrated circuit that performs any kind of processing function. In one example, the integrated circuit 110 is a buffer or an amplifier. Other examples of integrated circuits are possible. Although only one integrated circuit is shown in this example, it will be appreciated that multiple integrated circuits may also be deployed. And, as used herein, "integrated circuit (IC)" refers to any type of processing circuitry performing any type of processing function.

In the example assembly of FIGS. 1-2, the barrier or membrane 112 is porous mesh (e.g., a single or multiple layers of fabric, metal mesh, or membrane to mention a few examples) or porous filter material. For example, the barrier 112 may be a membrane or woven fabric to mention two examples. The barrier 112 is porous allowing sound to enter but is configured to prevent at least some contaminants from passing therethrough. In other aspects and as described elsewhere herein it can also be a patterned flex printed circuit board (PCB). In either case, the barrier 112 is embedded in the base 102. By "embedded" and as used herein, it is meant that the barrier 112 is not placed or attached to a top or bottom surface of the base 102, but instead is at least partially disposed or embedded within the base 102 and across the port 106. In this respect and as described elsewhere herein, the base 102 may include two or more printed circuit boards (PCBs) and the barrier 112 may be sandwiched or disposed.

Referring now especially to FIG. 2, an expanded cross-sectional view of the base 102 (with the embedded barrier 112) is described. The barrier 112 extends completely across the base 102. However, it will be appreciated that in some aspects the barrier 112 may be disposed in a cavity and not extend completely across the base 102. More specifically, a cavity may be created in the interior of the base 102 about or around the port 106 and the barrier 112 may be inserted into this cavity.

The base 102 in this example includes a first solder mask 152, a first metal layer 154, a first core layer 156, a second metal layer 158, a dielectric layer 160, a third metal layer 162, an adhesive layer 165, the barrier 112, another adhesive layer 167, a fourth metal layer 164, a second core layer 166, a fifth metal layer 168, and a second solder mask 170. The metal layers provide conductive paths for signals and may be constructed of copper clad in one example. The core layers may be FR-4 boards in one example. The port 106 extends through the base 102 but the barrier 112 extends across the port, permitting sound (indicated by air path 103) to enter the interior of the assembly but preventing contaminants from entering the assembly 100. The function of the dielectric layer 160 is to provide additional capacitance for improved electromagnetic immunity. It will be appreciated that the above-mentioned structure is only one possible structure and that other structures and configurations are possible. For instance, the dielectric layer (and the metal layers on either side of it) may be eliminated or additional PCB layers added.

Figure 3:
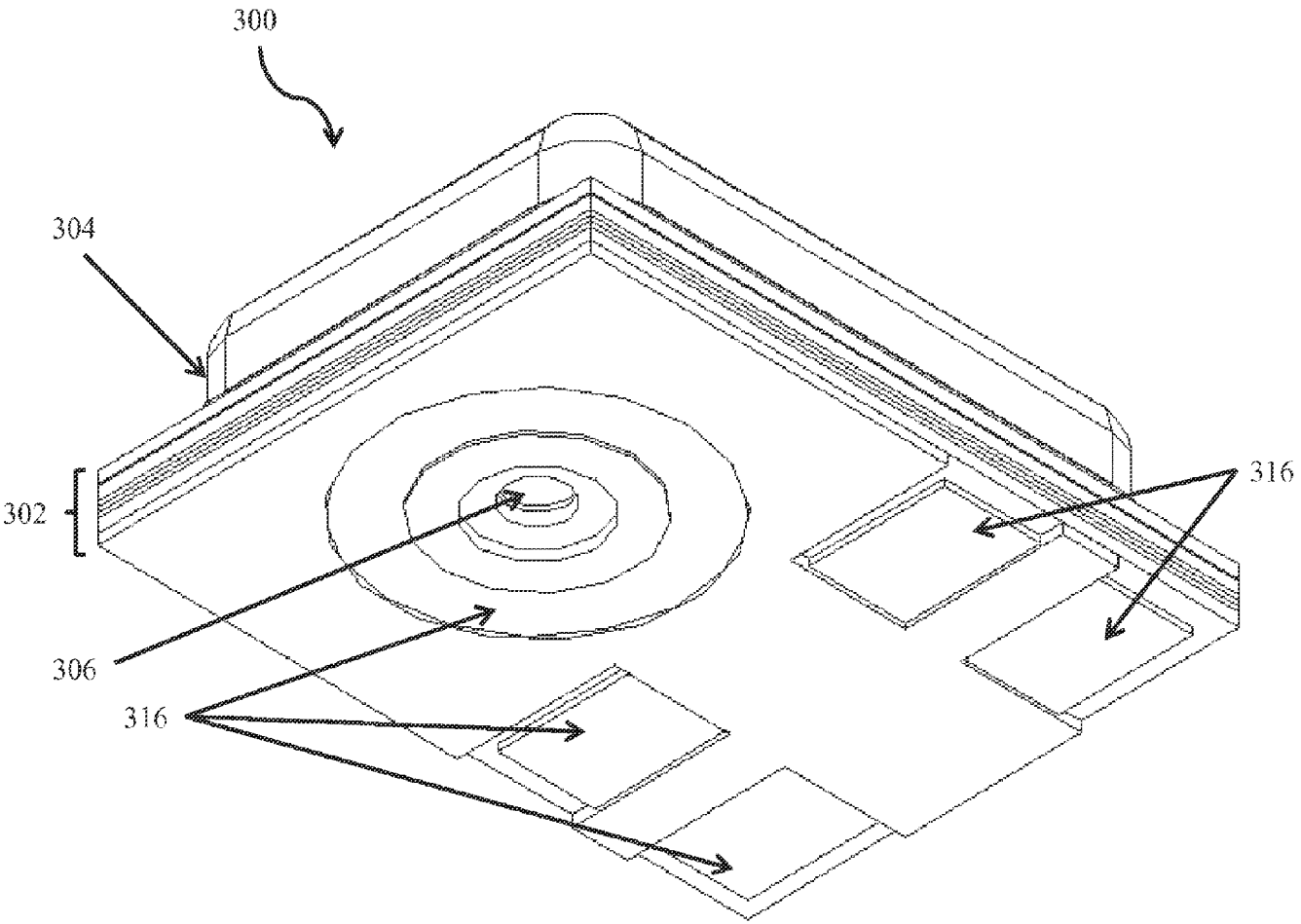
FIG. 3 comprises a perspective view of a MEMS assembly according to various embodiments of the present invention.
Figure 4:
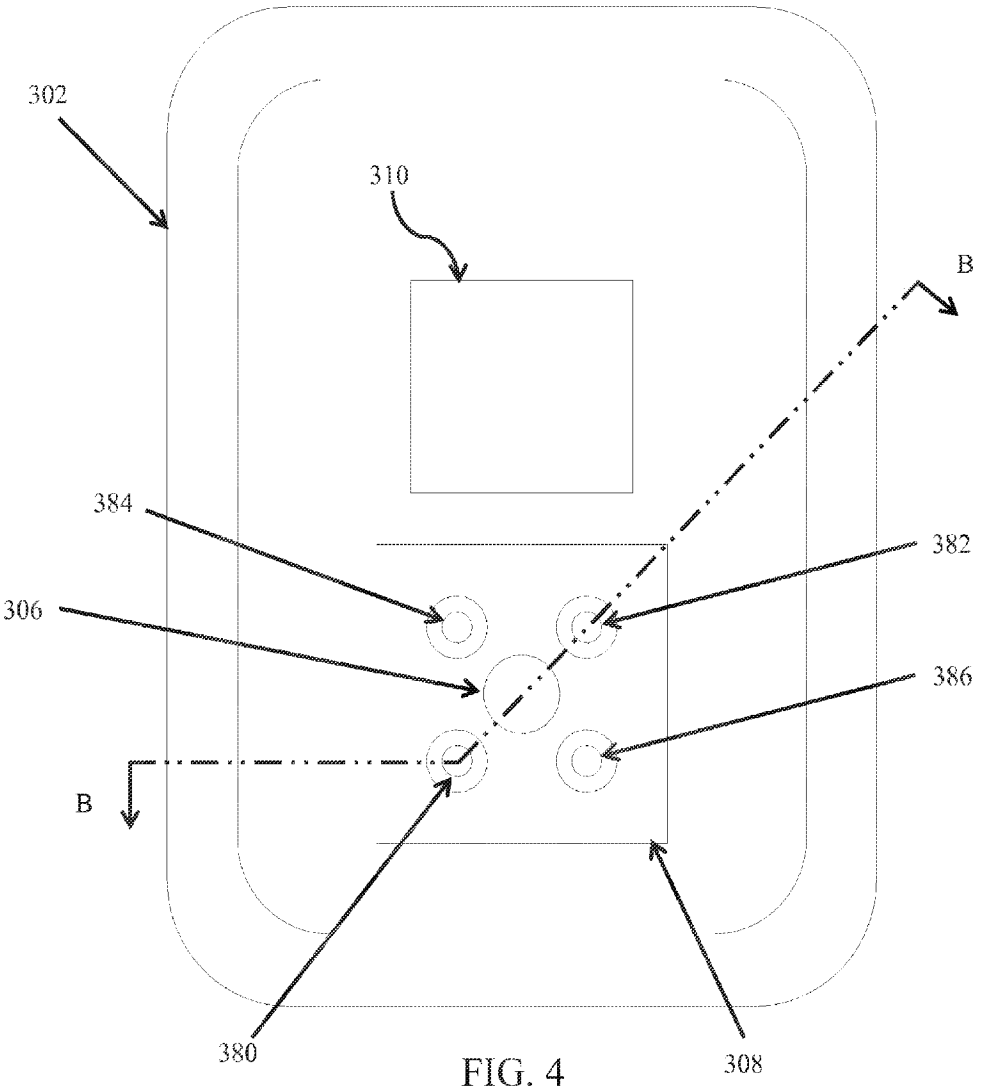
FIG. 4 comprises a top view of the inside of the assembly of FIG. 3 according to various embodiments of the present invention.
Figure 5:
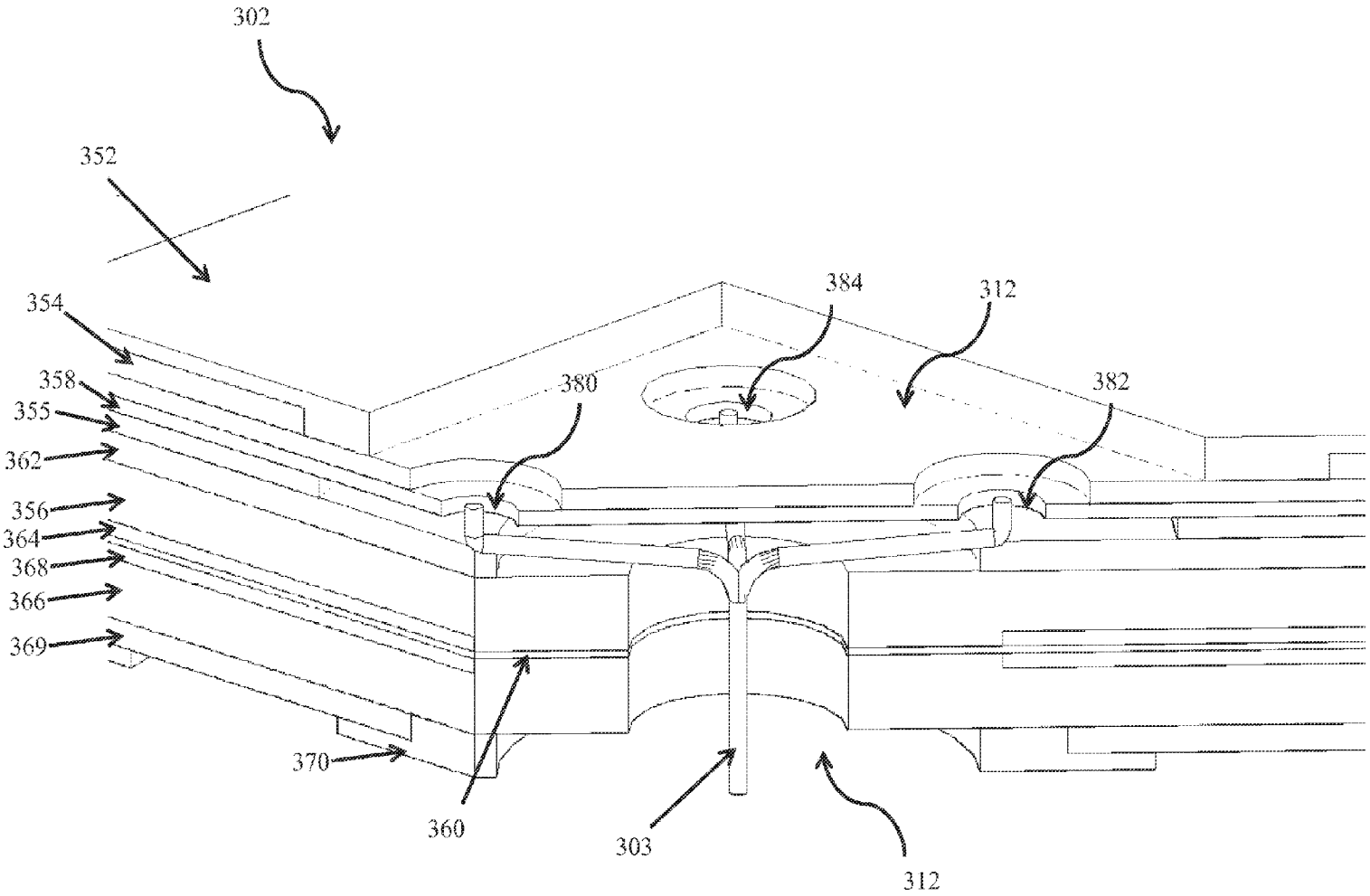
FIG. 5 comprises a cross-sectional view taken along line B-B of the barrier of FIGS. 3 and 4 according to various embodiments of the present invention.

Referring now to FIGS. 3-5, another example of an assembly with an embedded barrier 312 is described. In this example, the barrier 312 is a patterned rigid-flex PCB. By "flex," it is meant that flexible or compliant, such as polyimide film.

The assembly 300 includes a base 302, a lid 304, a port 306, a Microelectromechanical System (MEMS) apparatus 308, and an integrated circuit 310. The barrier 312 is embedded in the base 302, or on one side of the base (top or bottom). Although shown as being on top of the base 302 (making the assembly 300 a bottom port device), it will be appreciated that the port 306 can be moved to the lid 304 (thereby making the device a top port device) and the barrier 312 can be embedded in the lid 304.

Generally speaking and as described elsewhere herein, each of the lid 304 and base 302 are formed of one or more layers of materials. For example, these components may be constructed of FR-4 boards and printed circuit boards, and may have various conductive and insulating layers arranged around these boards.

The port 306 extends through the base 302 and the MEMS apparatus 308 extends over the port. Conductive traces (not shown) couple the output of the integrated circuit 310 to conductive pads 316 on the base. A customer can make an electrical connection with the pads 316 for further processing of the signal that is received from the integrated circuit 310.

The MEMS apparatus 308 receives acoustic energy which is transduced into electrical energy. In that respect, the MEMS apparatus 308 may include a diaphragm and a back plate. Acoustic energy causes movement of the diaphragm and this varies the charge between the diaphragm and the back plate. The resulting electrical signal that is produced represents the acoustic energy that has been received by the MEMS apparatus 308. The MEMS apparatus 308 is attached to the base by adhesive or any other appropriate fastening mechanism or approach.

The integrated circuit 310 is any kind of integrated circuit that performs any kind of processing function. In one example, the integrated circuit 310 is a buffer or an amplifier. Other examples of integrated circuits are possible. Although only one integrated circuit is shown in this example, it will be appreciated that multiple integrated circuits may be deployed. And as mentioned, as used herein "integrated circuit (IC)" refers to any type of processing circuitry performing any type of processing function.

In the example of FIGS. 3-5, the barrier 312 is a patterned flex printed circuit board (FPCB). By "patterned," it is meant that material is removed, for example, by photo lithography and etching or laser ablation to form either multiple circular openings or geometric shapes that allow for air to pass through in such a manner that it generates an indirect or tortuous path. Referring now especially to FIG. 5, an expanded view of the base (with the embedded barrier 312) is described. The barrier 312 extends completely across the base 302. However, it will be appreciated that in some aspects the barrier 312 may be disposed in a cavity and not extend completely across the base 302.

The base 302 includes a first solder mask 352, a first metal layer 354, the barrier 312 (a flex layer), a second metal layer 358, adhesive 355, a third metal layer 362, a first core layer 356, a fourth metal layer 364, a dielectric layer 360, a fifth metal layer 368, a second core layer 366, a sixth metal layer 369, and a second solder mask 370. The metal layers provide conductive paths for signals. The core layers may be FR-4 boards in one example. The port 306 extends through the base 302. The barrier 312 extends across the port 306 with circular openings 380, 382, 384, and 386 permitting sound (indicated by air path 303) to enter the interior of the assembly 300 but preventing at least some contaminants from entering the assembly 300. It will be appreciated that the above-mentioned structure is only one possible structure and that other structures are possible.

It will be appreciated that the shape, number, placement or other characteristics of the openings 380, 382, 384, and 386 in the barrier 312 may be adjusted to filter certain types or sizes of contaminants. More specifically, specific sizes and/or shapes for the openings may be advantageous from preventing certain-sized particulates from entering the interior of the assembly 300. The placement of the openings relative to each other may also serve to filter some types and/or sizes of contaminants. It should also be noted that the surface of barrier 312 may be treated with a hydrophobic coating to inhibit the liquid water from entering the interior of assembly 300.

In another example, the flex material or flex board is completely removed from extending over the port. In this case, one of the metal layers of the base can be extended over the port and include one or more openings that filter the contaminants. It will be appreciated that any of the other layers may be utilized to perform this function or that combinations of multiple layers (each having openings) may also be used.

Figure 6:
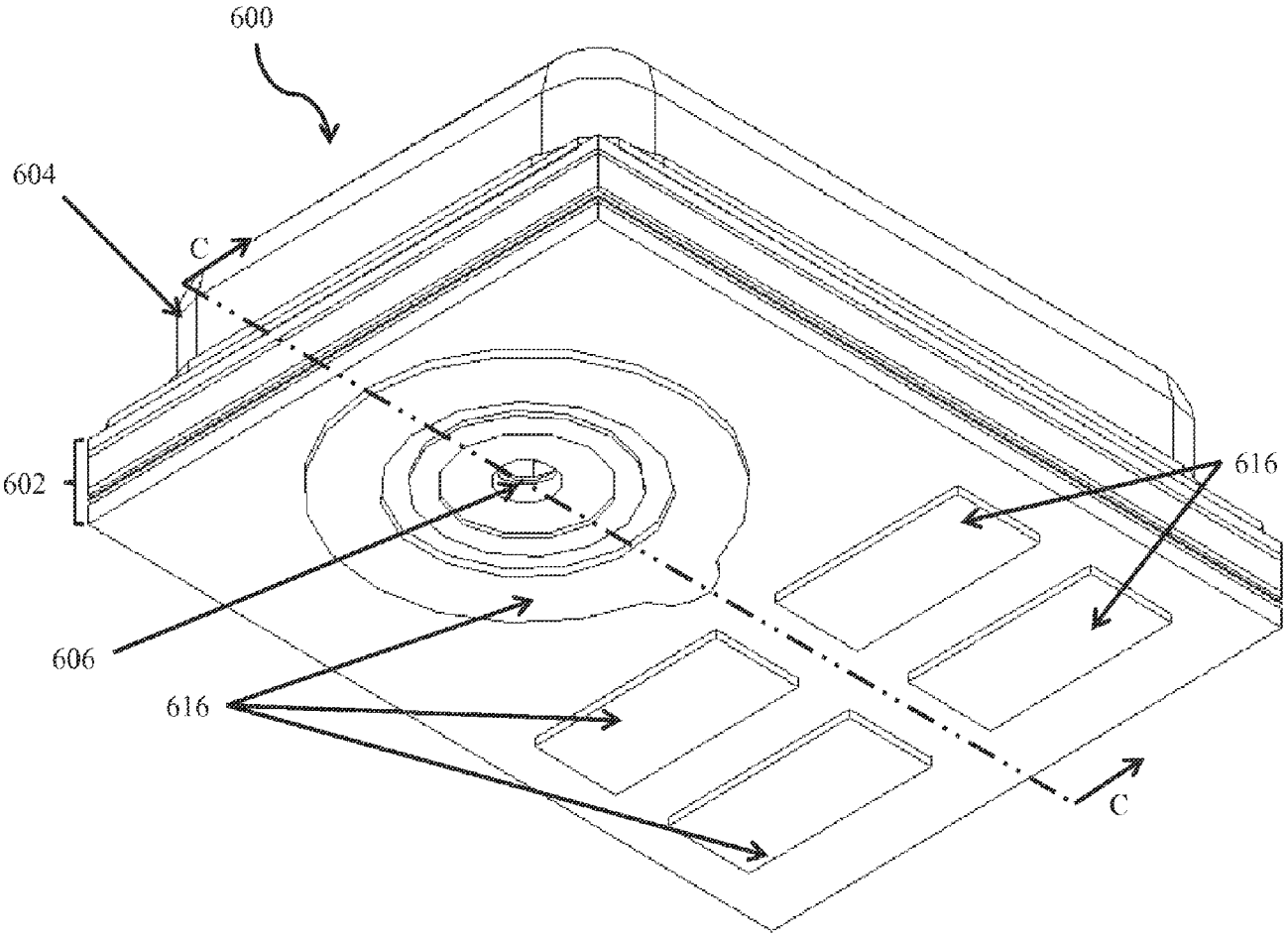
FIG. 6 comprises a perspective view of a MEMS assembly according to various embodiments of the present invention.
Figure 7:
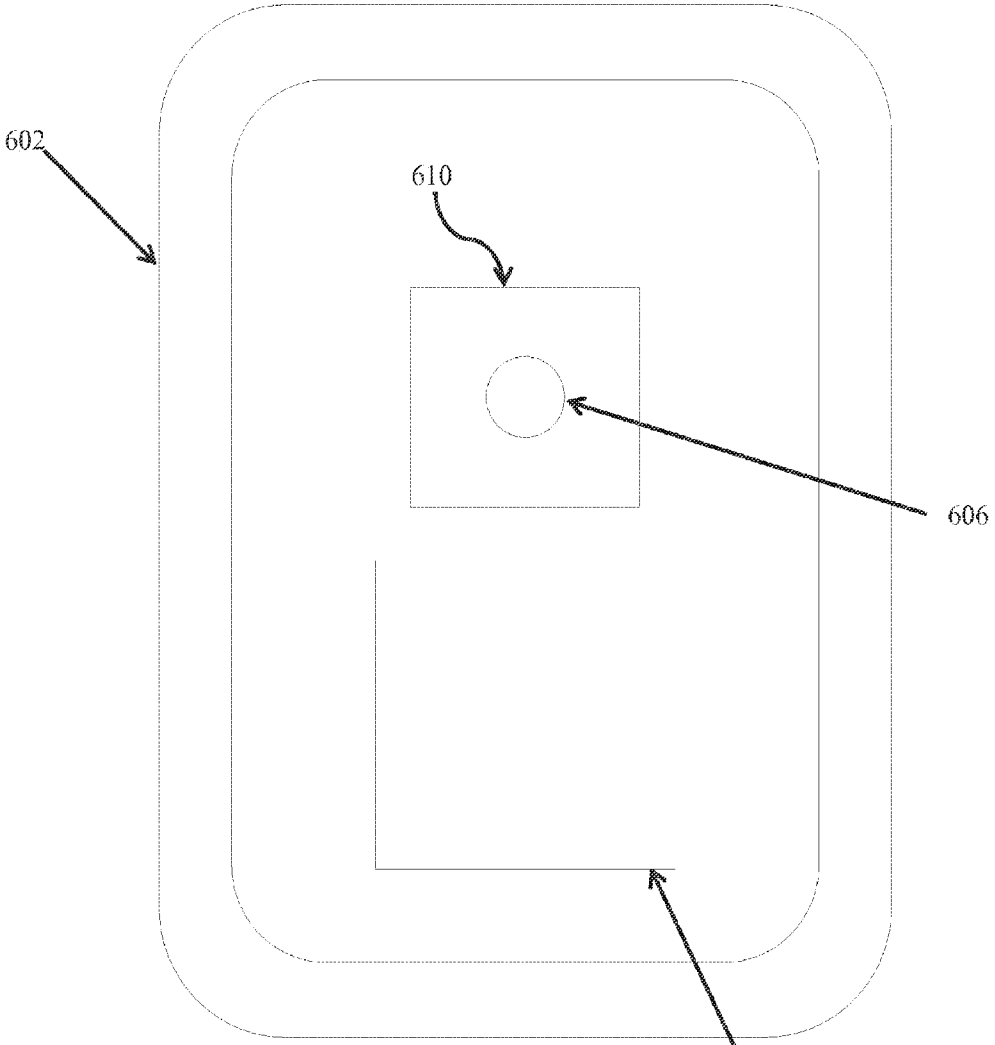
FIG. 7 comprises a top view of the base portion of the assembly of FIG. 6 according to various embodiments of the present invention.
Figure 8:
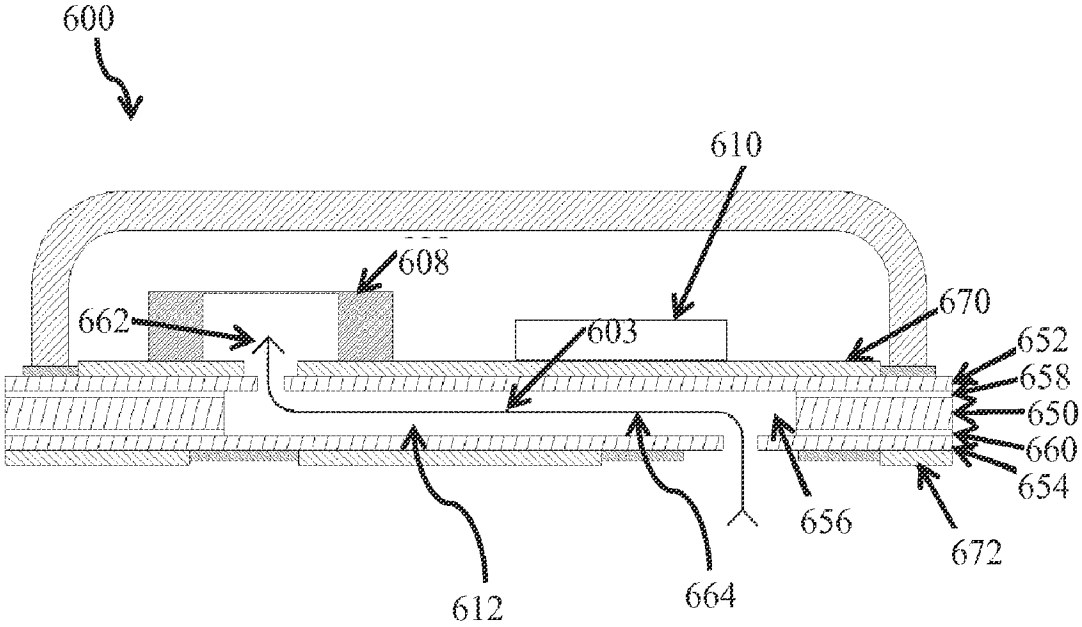
FIG. 8 comprises a cross-sectional view taken along line C-C of the barrier of FIGS. 6 and 7 according to various embodiments of the present invention.

Referring now to FIGS. 6-8, one example of a baffle structure that is disposed in the base of a MEMS assembly 600 and used as a particulate filter is described. The assembly 600 includes a base 602, a lid 604, a Microelectromechanical System (MEMS) apparatus 608, and an integrated circuit 610.

Each of the lid 604 and base 602 may be formed of one or more layers of materials. For example, these components may be constructed of FR-4 boards or printed circuit boards and may have various conductive and insulating layers arranged around these boards.

Conductive traces (not shown) couple the output of the integrated circuit 610 to conductive pads 616 on the base. A customer can make an electrical connection with the pads 616 for further processing of the signal that is received from the integrated circuit 610.

The MEMS apparatus 608 receives acoustic energy and which is transduced into electrical energy. In that respect, the MEMS apparatus 608 may include a diaphragm and a back plate. Acoustic energy causes movement of the diaphragm and this varies the voltage between the diaphragm and the back plate. The resulting electrical signal that is produced represents the acoustic energy that has been received by the MEMS apparatus 608. The MEMS apparatus 608 is attached to the base by adhesive or any other appropriate fastening mechanism or approach.

The integrated circuit 610 is any kind of integrated circuit that performs any kind of processing function. In one example, the integrated circuit 610 is a buffer or an amplifier. Other examples of integrated circuits are possible. Although only one integrated circuit is shown in this example, it will be appreciated that multiple integrated circuits may be deployed. And as mentioned, as used herein, "application specific integrated circuit (ASIC)" refers to any type of processing circuitry performing any type of processing function.

Referring now especially to FIG. 8, an expanded view of the base (with the baffle structure 612) is described. The base includes a first substrate (e.g., FR-4) 650, a first PCB 652, and a second PCB 654. An open cavity 656 is formed in the substrate 650. The two PCBs 652 and 654 are patterned for electrical trace routing. The PCBs 652 and 654 are also laminated with adhesive 658 and 660 to each side with adhesive to each side of the open cavity substrate 650. The adhesive 658 and 660 can be either a punched film adhesive or a printed adhesive. The adhesive flow is kept from filling the cavity 656 of the first substrate. Thru-hole vias (not shown) are drilled and plated to make the required electrical connections for operation of the assembly 600. Then, holes or openings 662 and 664 are drilled (e.g., using a laser or mechanical drill) through the first and second PCB boards 652 and 654. The holes or openings 662 and 664 are drilled from opposite sides of the finished laminated board and provide access to the cavity 656. In other words, the holes or openings 662 and 664 do not pass through all layers of the first and second PCB boards 652 and 654. Solder masks 670 and 672 are disposed on either side of the base 602. Together, the cavity 656 and holes or openings 662 and 664 form the baffle structure 612.

The hole or opening 662 communicates with the interior of the assembly 600 and is the sound inlet to the MEMS apparatus. The hole or opening 664 communicates with the exterior of the assembly 600 and is the acoustic port to a customer application. It will be appreciated that the holes or openings 662 and 664 are offset from each other and are in one aspect at opposite ends of the cavity 656. The placement of the holes or openings 662 and 664 in the cavity 656 provides a tortuous path for any contamination ingress into the open sound port of the microphone. After manufacturing of the substrate, the microphone assembly 600 is completed with the MEMS apparatus and integrated circuit attached, wire bonding, and lid attachment.

Figure 9:
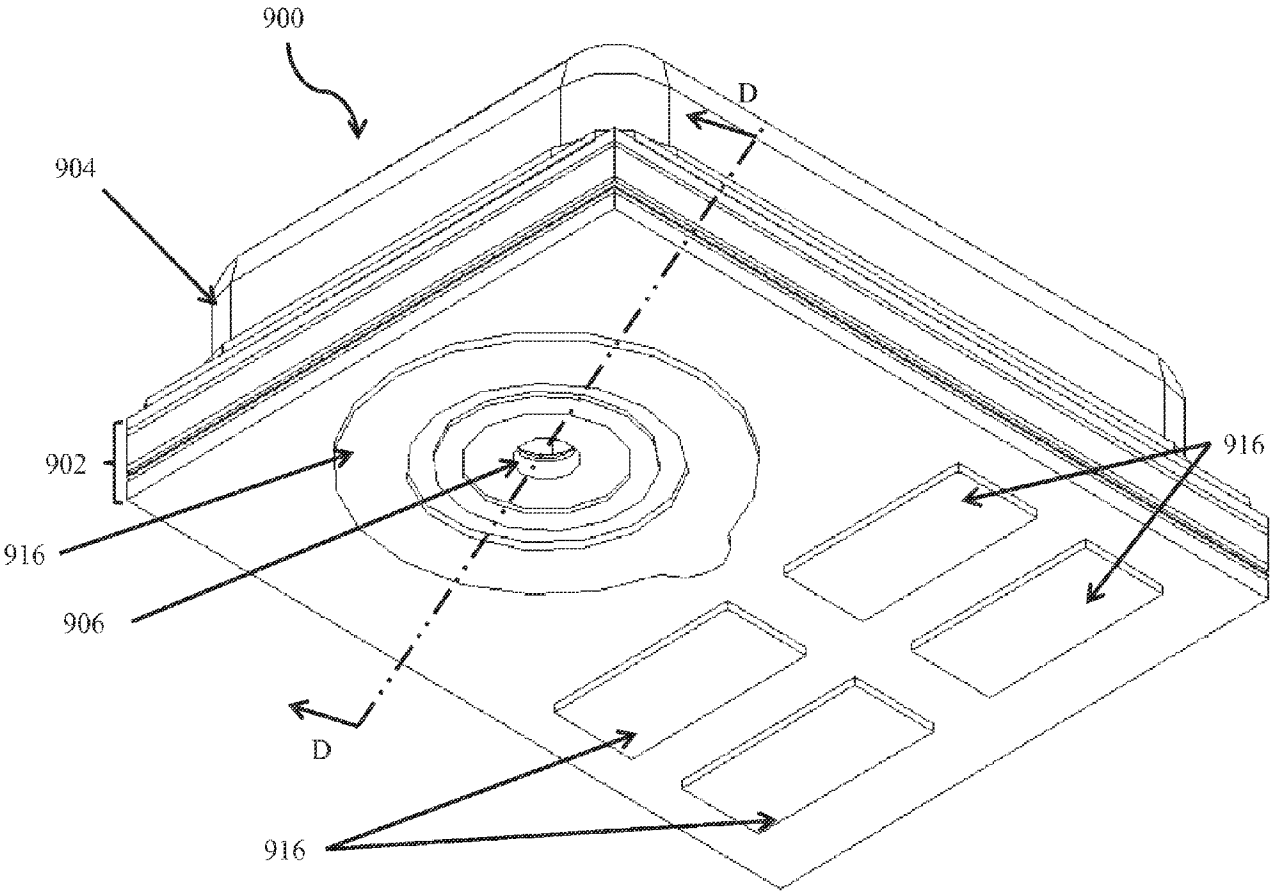
FIG. 9 comprises a perspective view of a MEMS assembly according to various embodiments of the present invention.
Figure 10:
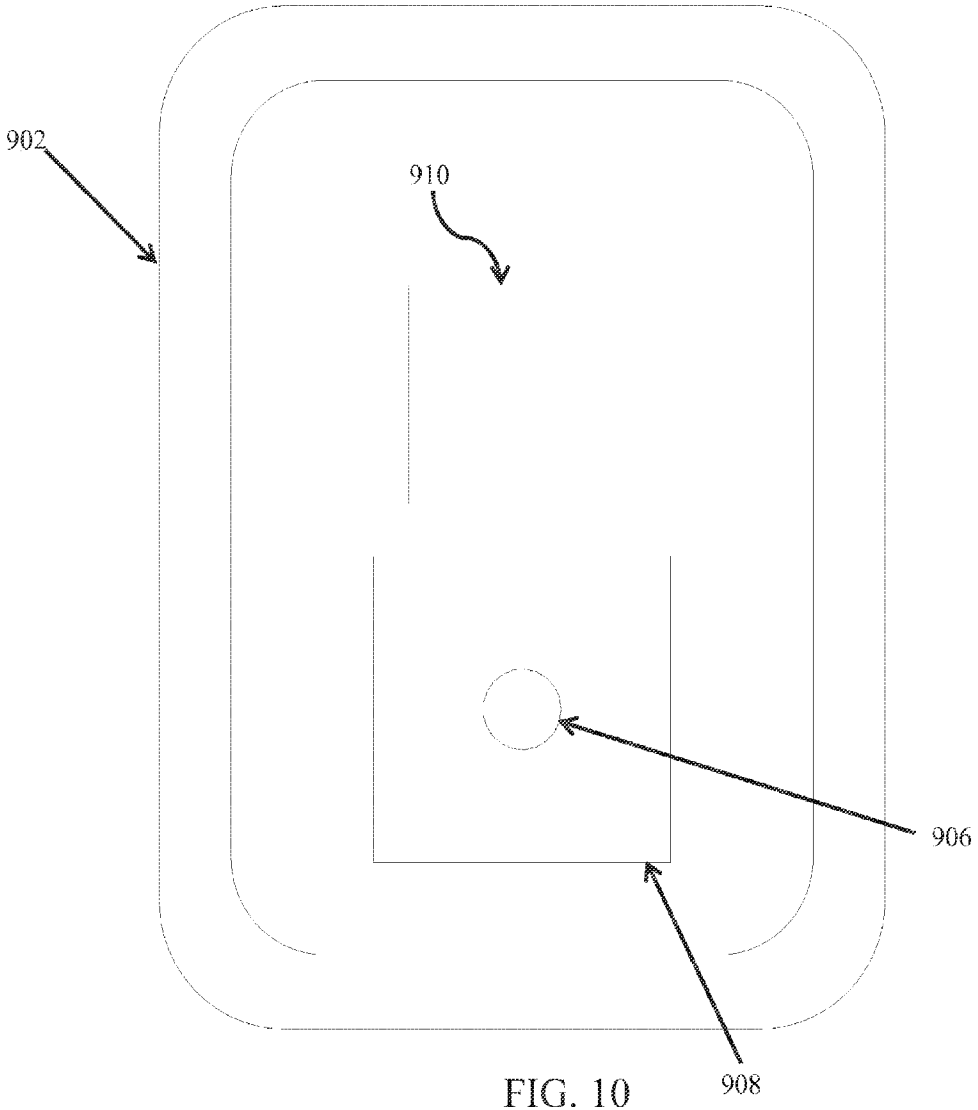
FIG. 10 comprises a top view of the base portion of the assembly of FIG. 9 according to various embodiments of the present invention.

It will be appreciated that sound (indicated by the arrow labeled 603) will traverse the baffle structure. However, at least some environmental contaminants may "stick" or otherwise remain in the baffle structure (e.g., in the cavity 656) and be prevented from entering the interior of the assembly 600, Referring now to FIGS. 9-11, another example of a baffle structure 912 disposed in the base of a MEMS assembly 900 that prevents at least some environmental contaminants from entering the interior of the assembly 900 is described. The assembly 900 includes a base 902, a lid 904, a Microelectromechanical System (MEMS) apparatus 908, and an integrated circuit 910.

Each of the lid 904 and base 902 may be formed of one or more layers of materials. For example, these components may be constructed of FR-4 boards and may have various conductive and insulating layers arranged around these boards.

Conductive traces (not shown) couple the output of the integrated circuit 910 to conductive pads 916 on the base. A customer can make an electrical connection with the conductive pads 916 for further processing of the signal that is received from the integrated circuit 910.

The MEMS apparatus 908 receives acoustic energy which is transduced into electrical energy. In that respect, the MEMS apparatus 908 may include a diaphragm and a back plate. Acoustic energy causes movement of the diaphragm and this varies the charge between the diaphragm and the back plate. The resulting electrical signal that is produced represents the acoustic energy that has been received by the MEMS apparatus 908. The MEMS apparatus 908 is attached to the base by adhesive or any other appropriate fastening mechanism or approach.

The integrated circuit 910 is any kind of integrated circuit that performs any kind of processing function. In one example, the integrated circuit 910 is a buffer or an amplifier. Other examples of integrated circuits are possible. Although only one integrated circuit is shown in this example, it will be appreciated that multiple integrated circuits may be deployed. And as mentioned, as used herein, "integrated circuit (IC)" refers to any type of processing circuitry performing any type of processing function.

Figure 11A:
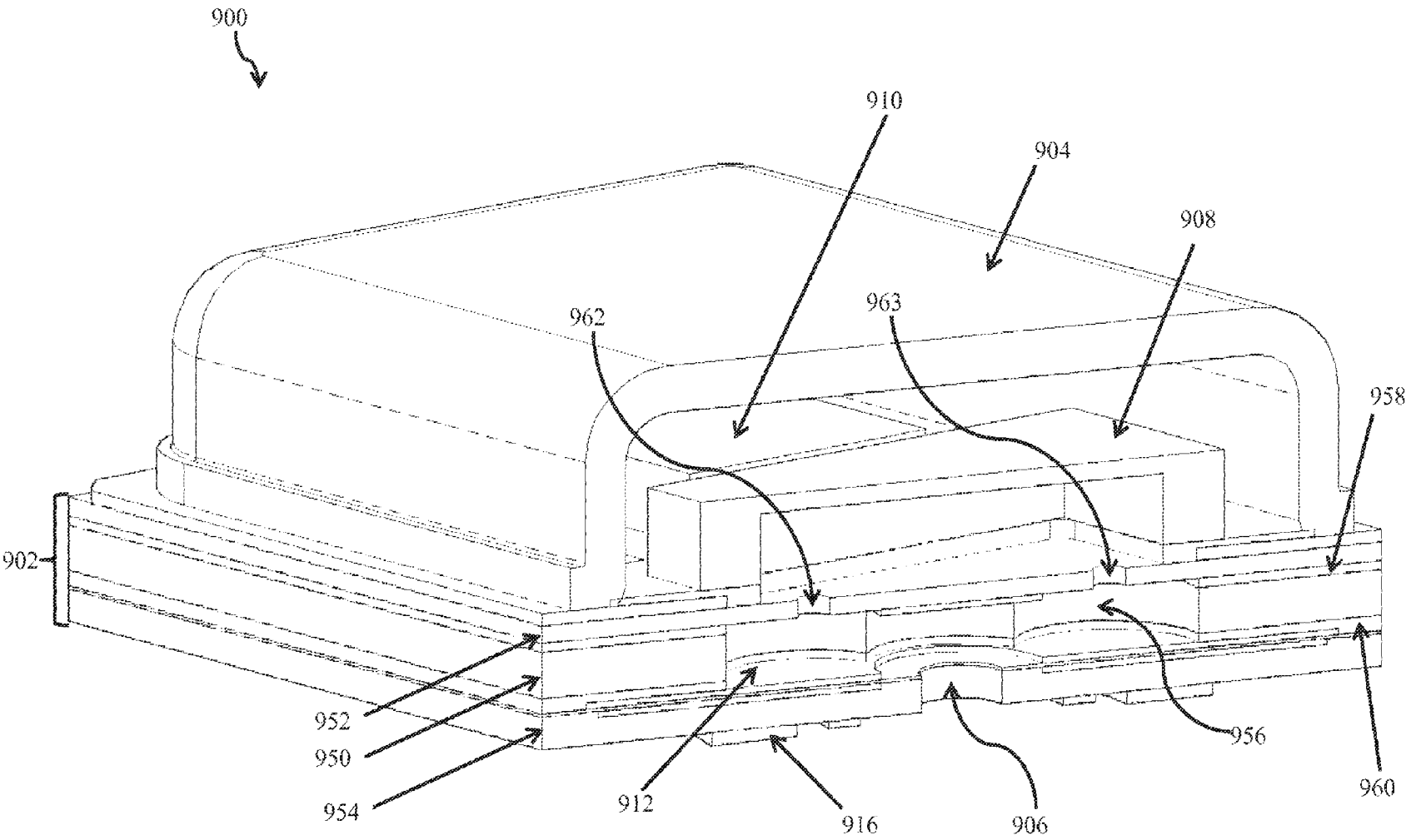
FIG. 11A comprises a cross-sectional perspective view taken along line D-D of the barrier of FIGS. 9 and 10 according to various embodiments of the present invention.

Referring now especially to FIG. 11A, an expanded perspective cutaway view of the assembly (with the baffle structure 912) is described. The base includes a first substrate (e.g., FR-4) 950, a first PCB 952, and a second PCB 954. An open cavity 956 is formed in the substrate 950. The two PCBs 952 and 954 are patterned for electrical trace routing. These two PCBs 952 and 954 are laminated with adhesive 958 and 960 to each side with adhesive to each side of the first substrate 950 containing the open cavity or baffle 956. The adhesive 958 and 960 can be, for example, either a punched film adhesive or a printed adhesive. The adhesive flow is kept from filling the cavity of the first substrate. Thru hole vias (not shown) are drilled and plated to make the required electrical connections for operation of the assembly 900. Then, holes or openings 962, 963 and 906 are drilled through the first and second PCB boards. The holes or openings 962, 963 and 906 may be drilled using lasers or mechanical drilling approaches and are in one aspect drilled from opposite sides of the finished laminated board and provide access to the cavity 956. In other words, the holes or openings 962, 963, and 906 do not pass through all layers of the first and second PCB boards 952 and 954. Together, the holes or openings 962, 963, port 906, and cavity 956 form the baffle structure 912.

The holes or openings 962 and 963 are the sound inlets to the MEMS apparatus and the port hole 906 (disposed in the middle of the cavity 956) is the acoustic port to a customer application. The placement of the holes in the cavity provides a tortuous path for any contamination ingress into the open sound port of the microphone. After manufacturing of the substrate, the microphone assembly 900 is completed with the MEMS apparatus 908 and integrated circuit 910 attached, wire bonding, and lid attachment.

Figure 11B:
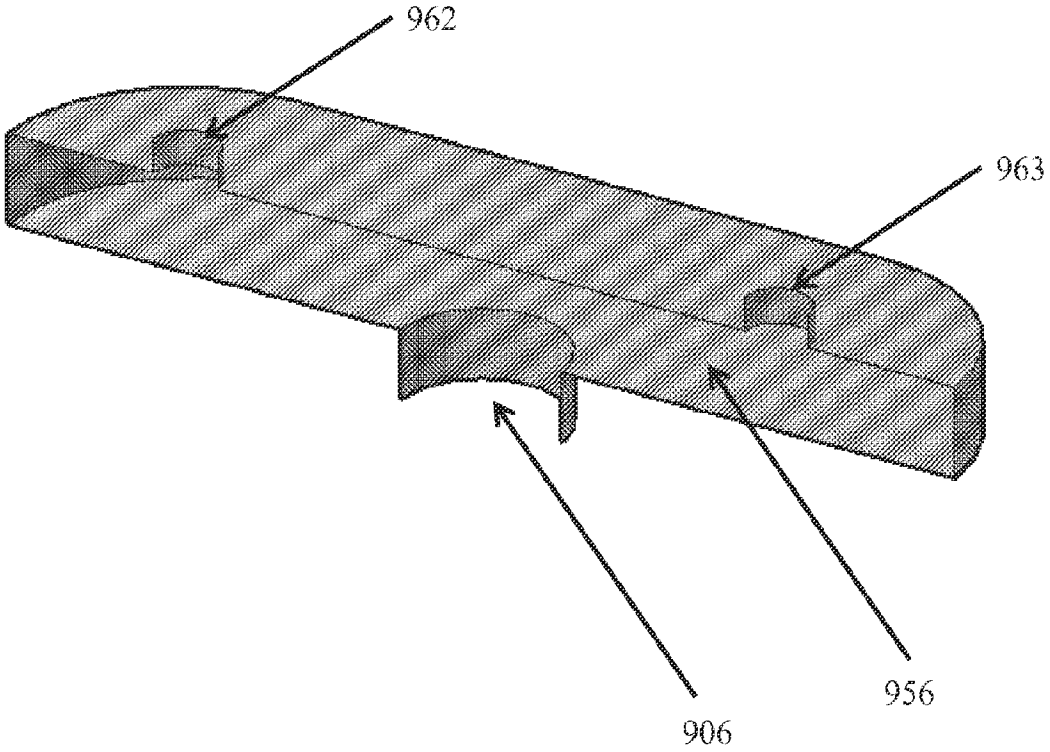
FIG. 11B comprises a cross-sectional view of one example of a baffle according to various embodiments of the present invention.
Figure 11C:
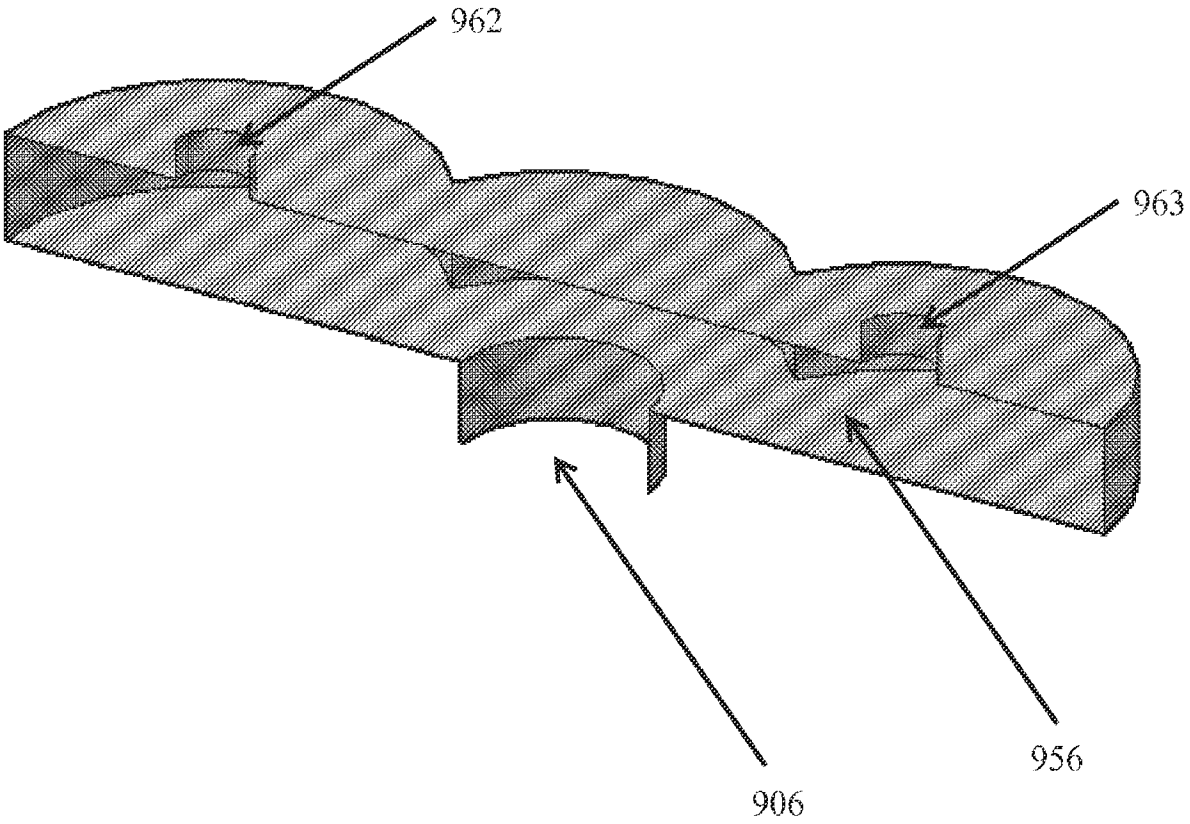
FIG. 11C comprises a cross-sectional view of another example of a baffle according to various embodiments of the present invention.

Referring now to FIGS. 11B and 11C it can be seen that the shape of the cavity 956 can be changed from a long and relatively straight configuration (FIG. 11B) to a configuration (FIG. 11C) with several curved notches. The shape of the cavity 956 can be changed, for example, to filter certain types and sizes of contaminants as opposed to other types and sizes. The shape and height of the cavity 956 can also be changed to affect acoustic response of the microphone assembly. Using these approaches, at least some contaminants may be contained within the baffle structure (e.g., they may adhere to or become somehow lodged in this structure).

Figure 12:
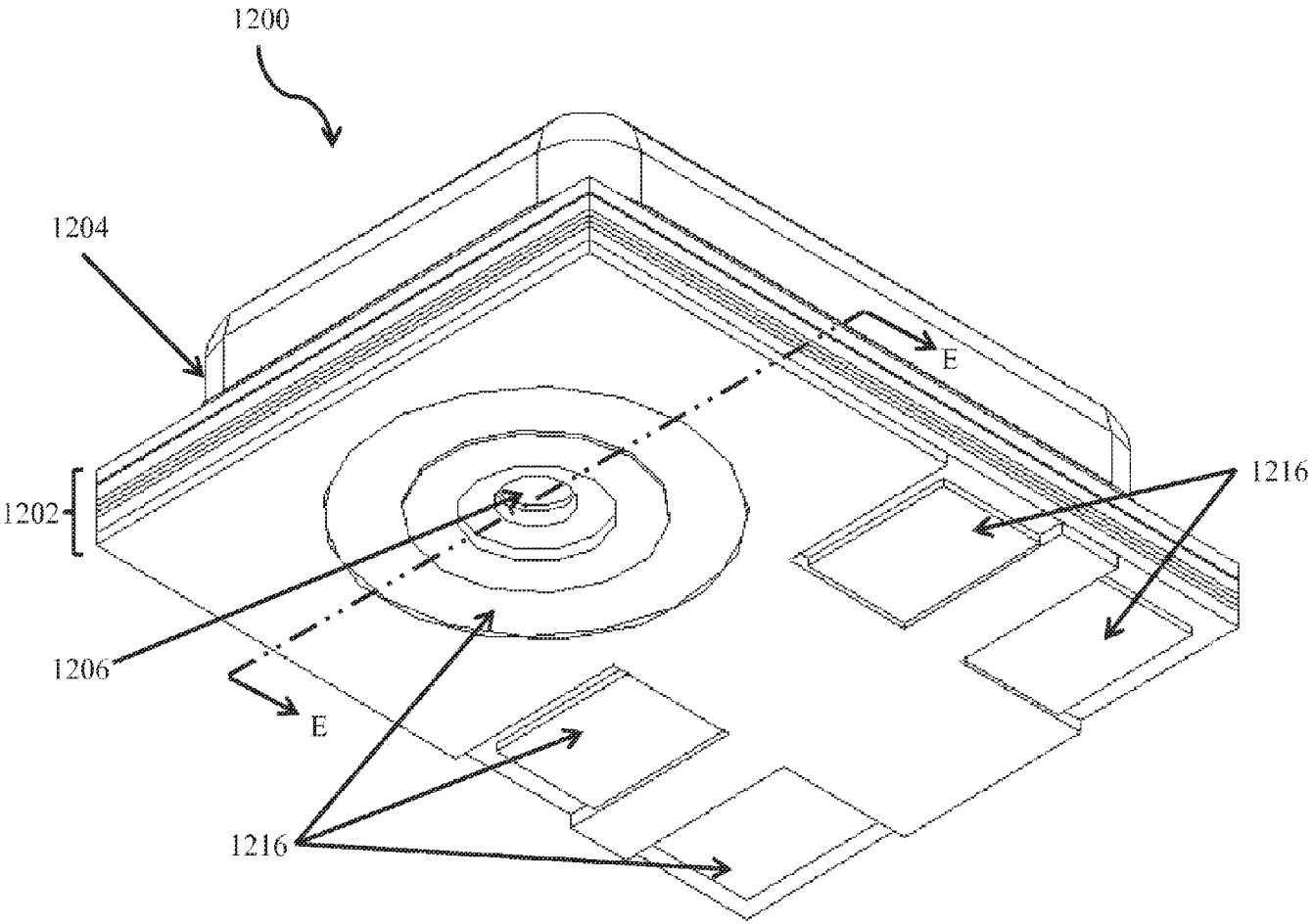
FIG. 12 comprises a perspective view of a MEMS assembly with barrier over port according to various embodiments of the present invention.
Figure 13:
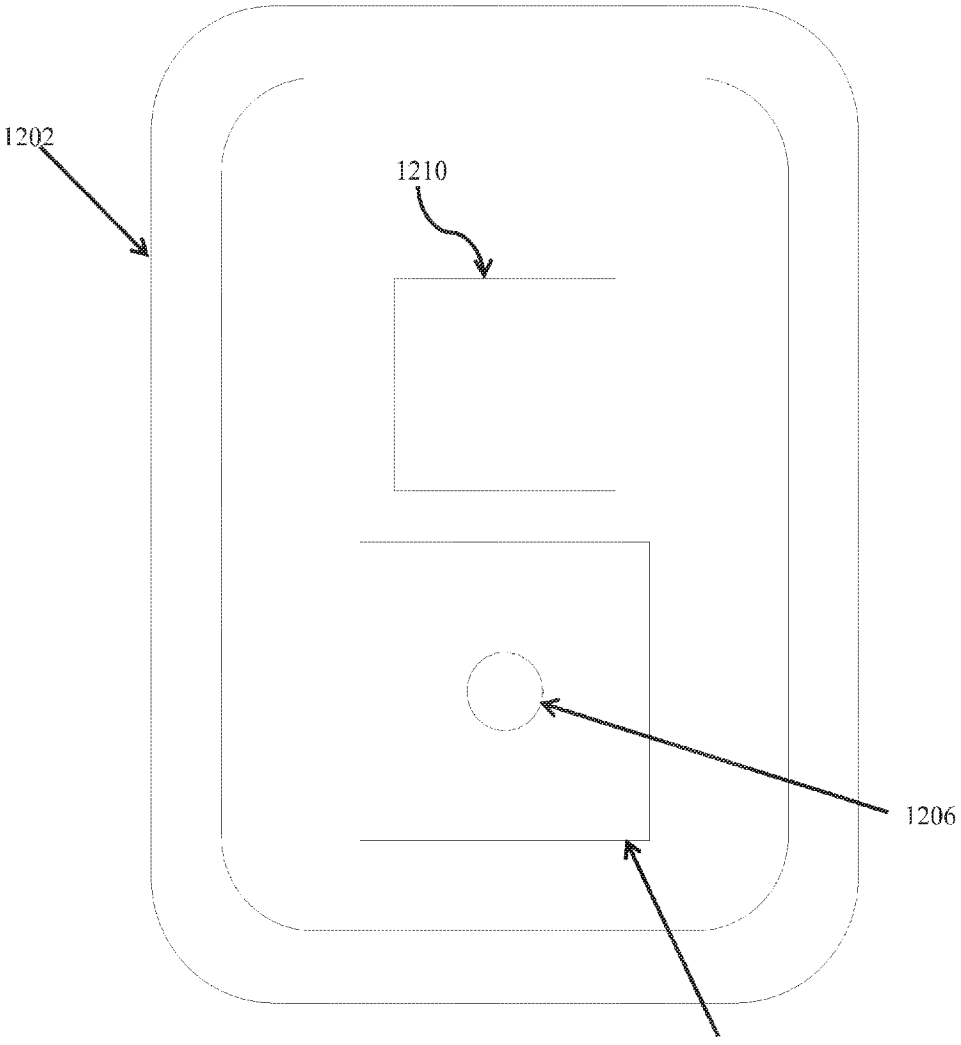
FIG. 13 comprises a top view of the base portion of the assembly of FIG. 12 according to various embodiments of the present invention.
Figure 14:
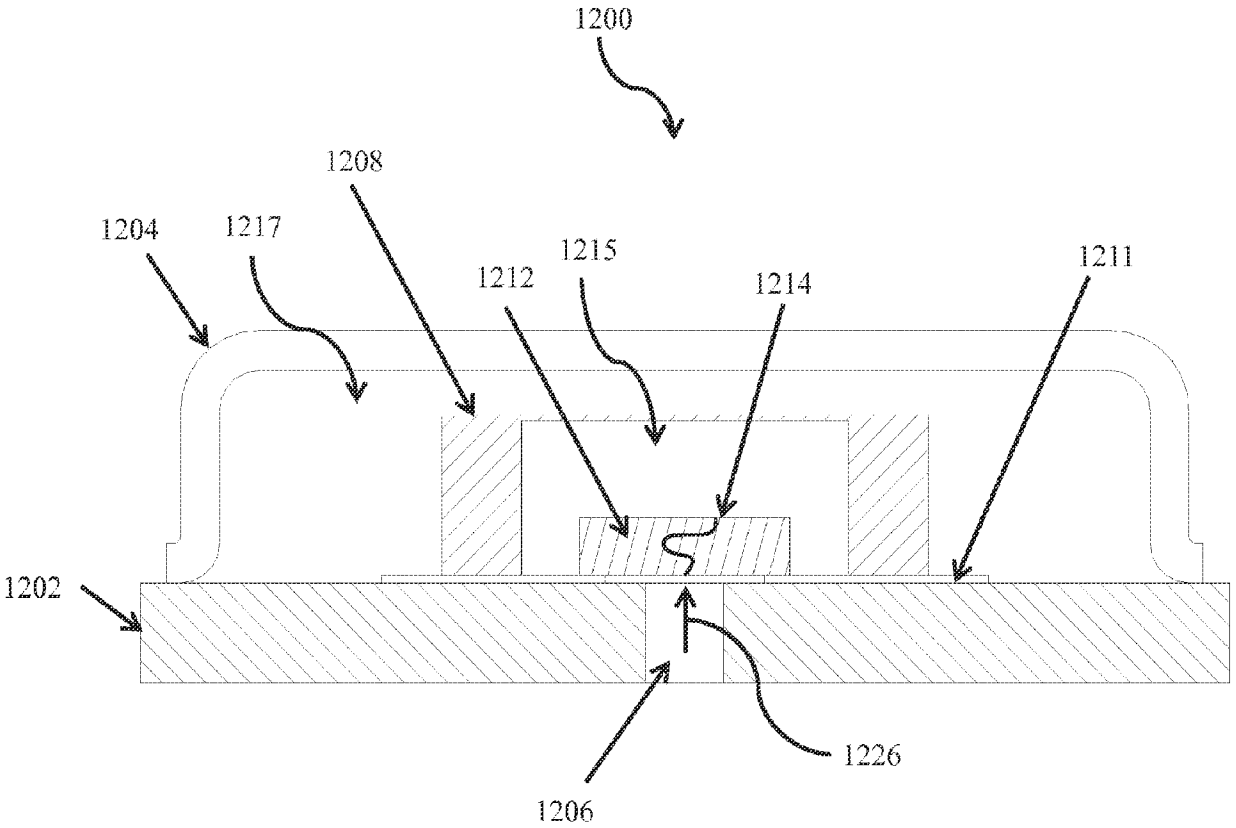
FIG. 14 comprises a cross-sectional perspective view taken along line E-E of the barrier of FIGS. 12 and 13 according to various embodiments of the present invention.

Referring now to FIGS. 12-14, another example of a MEMS assembly 1200 having a tortuous path for acoustic energy to prevent particulate infiltration is described. The assembly 1200 includes a base 1202, a lid 1204, a port 1206, a Microelectromechanical System (MEMS) apparatus 1208, a barrier 1212, and an integrated circuit 1210.

Generally speaking and as described elsewhere herein, each of the lid 1204 and base 1202 are formed of one or more layers of materials. For example, these components may be constructed of FR-4 boards and may have various conductive and insulating layers arranged around these boards.

The port 1206 extends through the base 1202 and the MEMS apparatus 1208 extends across the port. Conductive traces (not shown) couple the output of the integrated circuit 1210 to conductive pads 1216 on the base. A customer can make an electrical connection with these pads for further processing of the signal that is received from the integrated circuit 1210.

The MEMS apparatus 1208 receives acoustic energy which is transduced into electrical energy. In that respect, the MEMS apparatus 1208 may include a diaphragm and a back plate. Acoustic energy causes movement of the diaphragm and this varies the voltage between the diaphragm and the back plate. The resulting electrical signal that is produced represents the acoustic energy that has been received by the MEMS apparatus 1208. The MEMS apparatus 1208 is attached to the base by die attach adhesive 1211 or any other appropriate fastening mechanism or approach.

The integrated circuit 1210 is any kind of integrated circuit that performs any kind of processing function. In one example, the integrated circuit 1210 is a buffer or an amplifier. Other examples of integrated circuits are possible. Although only one integrated circuit is shown in this example, it will be appreciated that multiple integrated circuits may be deployed.

The barrier 1212 is in one aspect a silicon piece that extends across and over the port 1206 and within (under) the MEMS apparatus 1208. The barrier 1212 has an elongated tunnel 1214 with turns that acts as a particulate filter in the assembly 1200. The tunnel 1214 is an extended hollow opening (i.e., in the shape of a tube) through which sound traverses and can be created using a variety of different approaches such as stealth laser dicing and chemical etching.

A path for sound is indicated by the arrow labeled 1226 and this follows and proceeds through the tunnel 1214. The barrier 1212 is disposed in the front volume 1215 and not the back volume 1217. Particulates will be trapped within, adhere with, or become lodged within the tunnel 1214 (e.g., at turns within the tunnel 1214) and thereby be prevented from entering the interior of the assembly 1200 but not completely obstructing the tunnel. This disposition of the barrier 1212 under the MEMS apparatus 1208 may improve the acoustic performance of the assembly 1500 by decreasing the front volume 1215 that would otherwise be present.

The barrier 1212 can have a wide variety of dimensions. In one illustrative example, the barrier 1212 is approximately 0.5 mm long by approximately 0.5 mm wide by approximately 0.15 mm thick. The tunnel 1214 can also have a variety of different shapes and dimensions.

Figure 15:
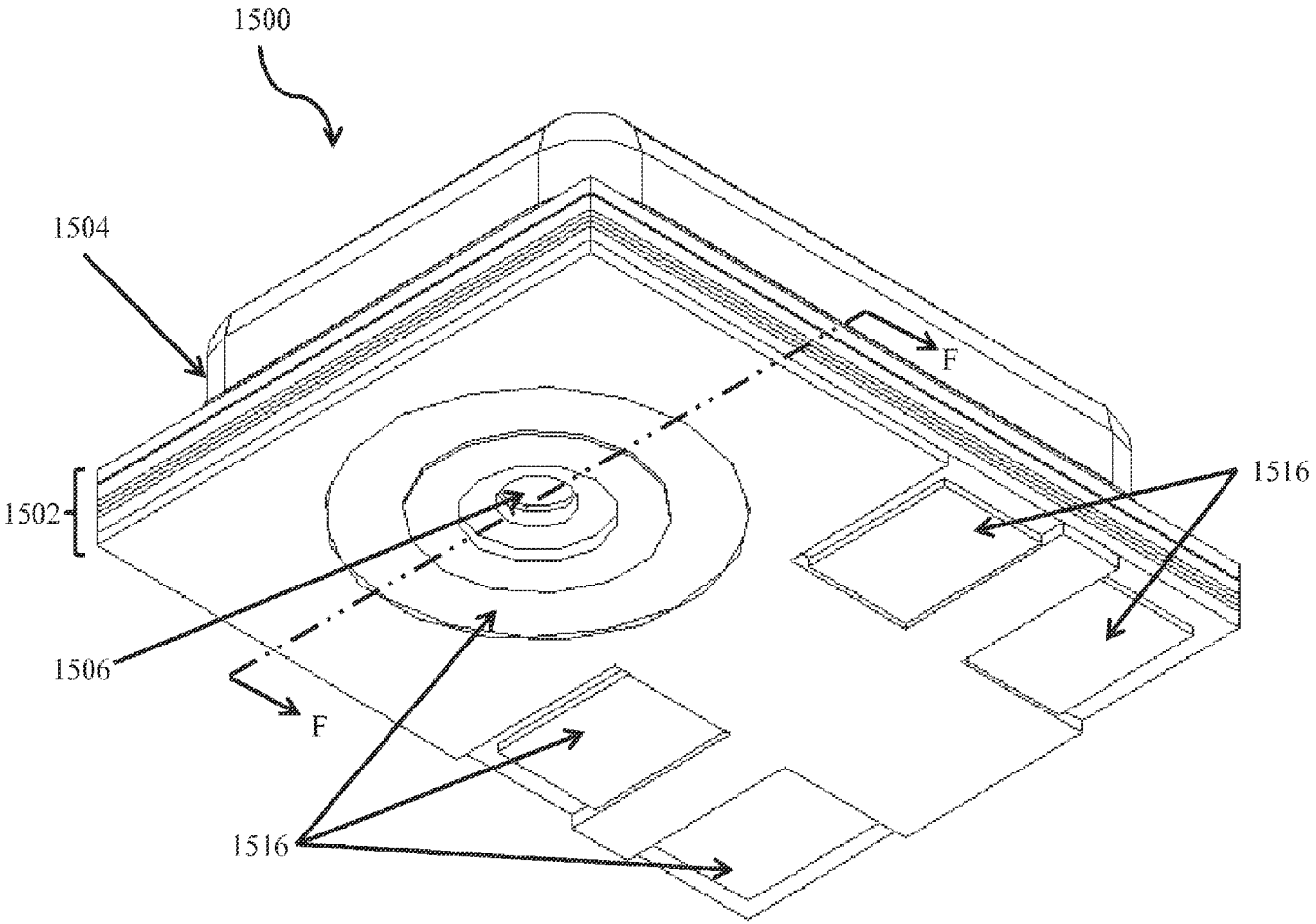
FIG. 15 comprises a perspective view of a MEMS assembly with barrier over port according to various embodiments of the present invention.
Figure 16:
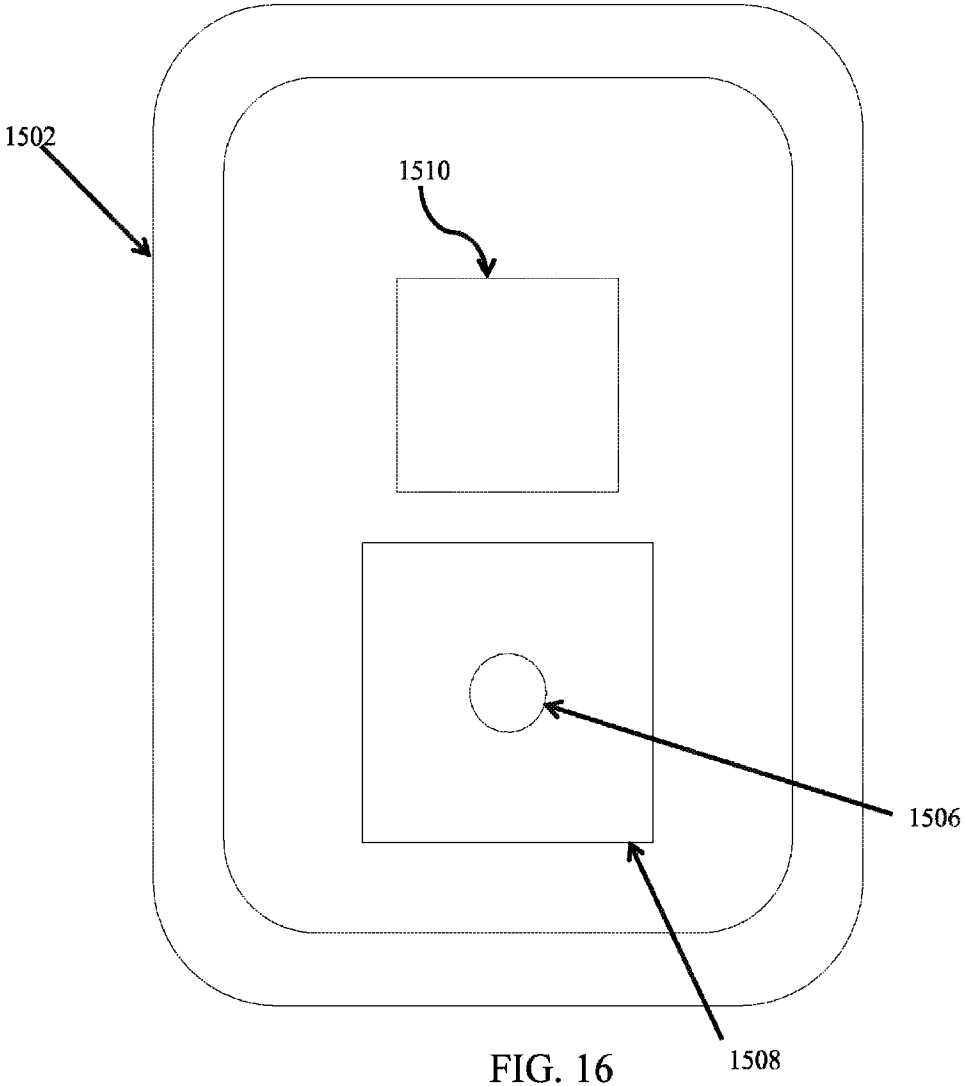
FIG. 16 comprises a top view of the base portion of the assembly of FIG. 15 according to various embodiments of the present invention.
Figure 17:
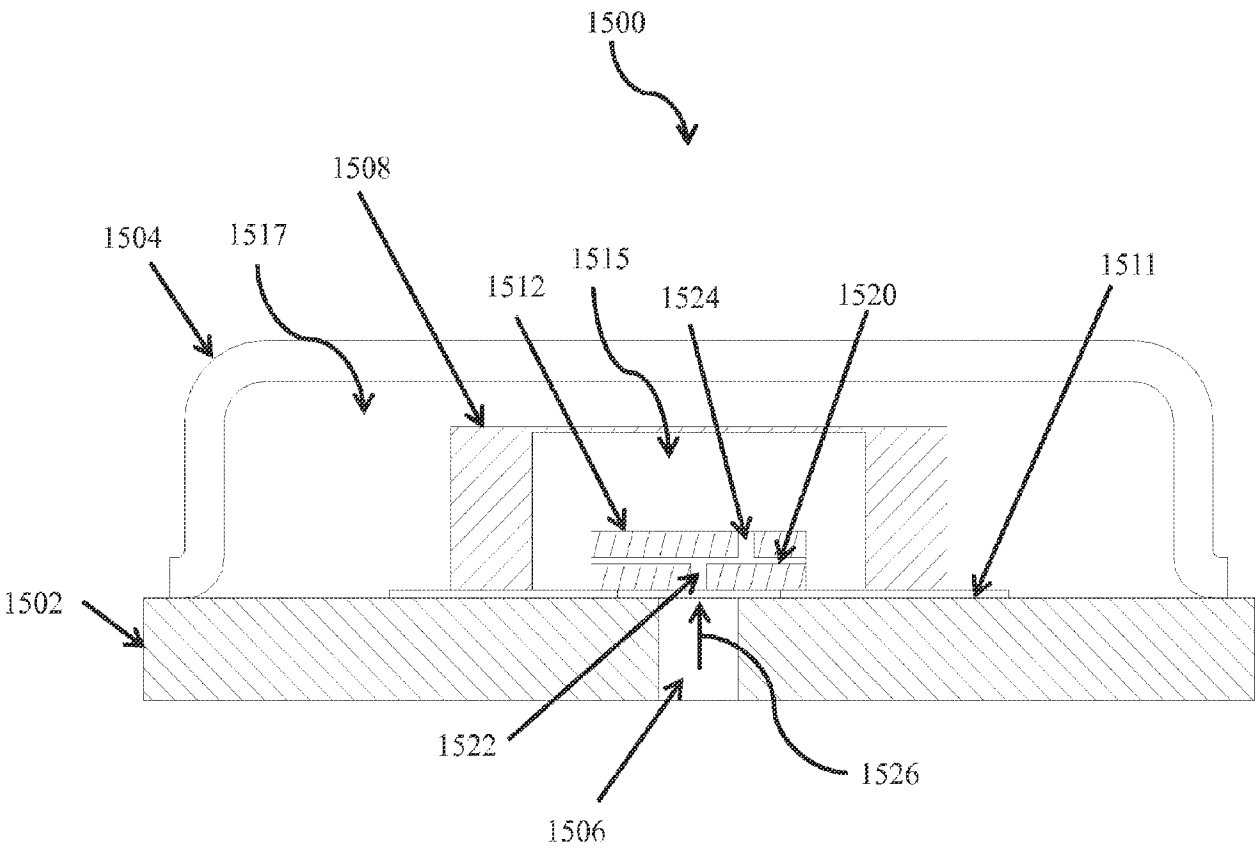
FIG. 17 comprises a cross-sectional perspective view taken along line F-F of the barrier of FIGS. 15 and 16 according to various embodiments of the present invention.

Referring now to FIGS. 15-17, another example of a MEMS assembly 1500 having a tortuous path for acoustic energy that prevents particulate infiltration in the assembly is described. The assembly 1500 includes a base 1502, a lid 1504, a port 1506, a Microelectromechanical System (MEMS) apparatus 1508, a barrier 1512, and an integrated circuit 1510.

Generally speaking and as described elsewhere herein, each of the lid 1504 and base 1502 are formed of one or more layers of materials. For example, these components may be constructed of FR-4 boards and may have various conductive and insulating layers arranged around these boards.

The port 1506 extends through the base 1502 and the MEMS apparatus 1508 extends across the port 1506. Conductive traces (not shown) couple the output of the integrated circuit 1510 to conductive pads 1516 on the base. A customer can make an electrical connection with these pads for further processing of the signal that is received from the integrated circuit 1510.

The MEMS apparatus 1508 receives acoustic energy which is transduced into electrical energy. In that respect, the MEMS apparatus 1508 may include a diaphragm and a back plate. Acoustic energy causes movement of the diaphragm and this varies the charge between the diaphragm and the back plate. The resulting electrical signal that is produced represents the acoustic energy that has been received by the MEMS apparatus 1508. The MEMS apparatus 1508 is attached to the base by die attach adhesive 1511 or any other appropriate fastening mechanism or approach.

The integrated circuit 1510 is any kind of integrated circuit that performs any kind of processing function. In one example, the integrated circuit 1510 is a buffer or an amplifier. Other examples of integrated circuits are possible. Although only one integrated circuit is shown in this example, it will be appreciated that multiple integrated circuits may be deployed.

The barrier 1512 is in one aspect a silicon piece that extends across and over the port 1506 and within (under) the MEMS apparatus 1508. The barrier 1512 includes a tunnel 1520 (that can be a curved tunnel or a straight tunnel). Communicating with the tunnel 1520 is a first trench 1522 and a second trench 1524. A sound path (the arrow with the label 1526) is shown for sound entering the port 1506, passing through the first trench 1522, moving through the horizontal tunnel 1520, moving through the second trench 1524, and then being received at the MEMS apparatus 1508. The tunnel 1520 can be created by various approaches, for example, by stealth laser dicing or chemical etching. The trenches 1522 and 1524 can be created, for instance, by dry etching approaches. The long path created as sound traverses the trenches and tunnel acts as a particle filter. This disposition of the barrier 1512 beneath the MEMS apparatus 1508 may improve the acoustic performance of the assembly 1500 by decreasing the front volume that would otherwise be present.

The barrier 1512 can have a wide variety of dimensions. In one illustrative example, the barrier 1512 is approximately 0.5 mm long by approximately 0.5 mm wide by approximately 0.15 mm thick.

Figure 18:
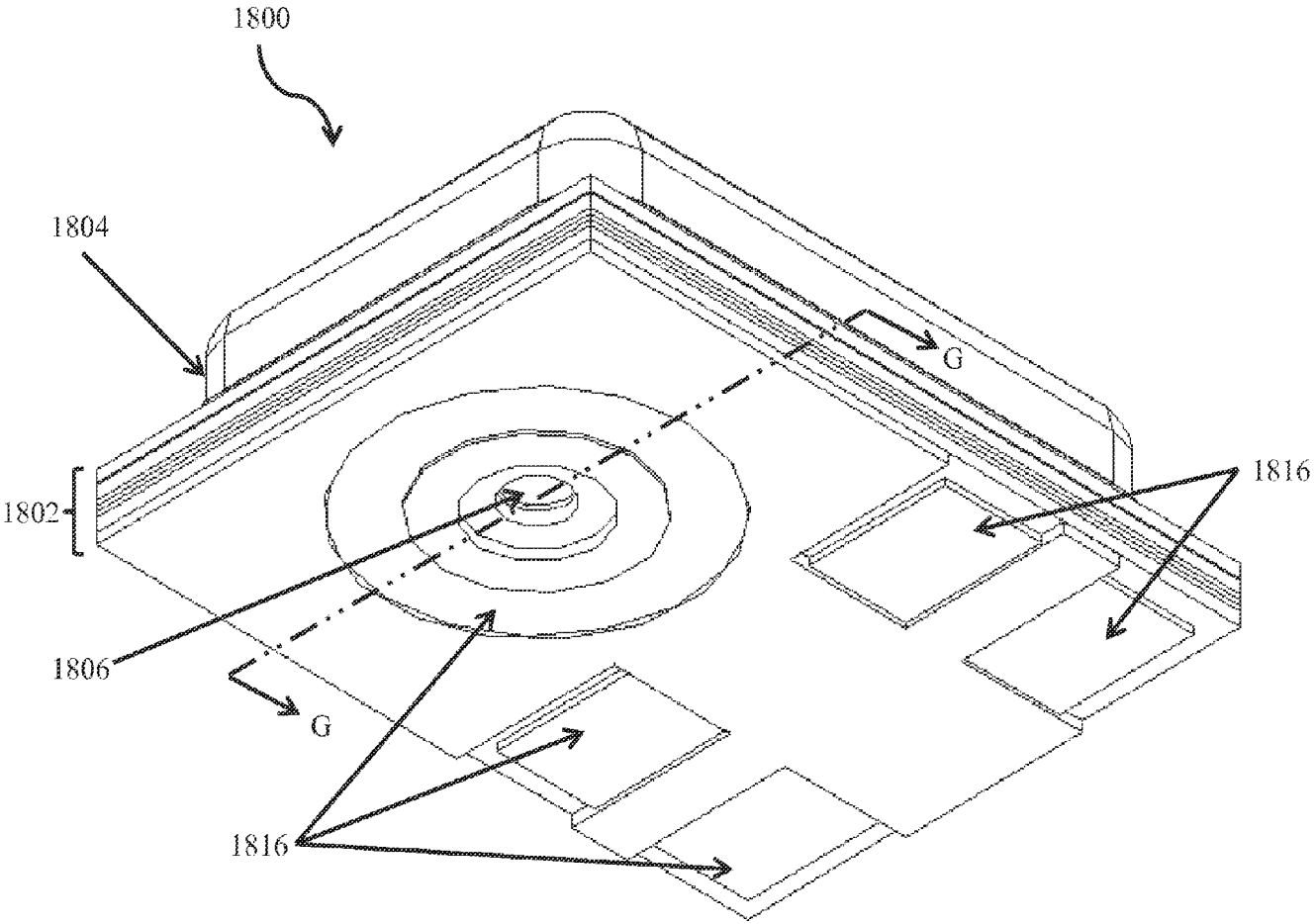
FIG. 18 comprises a perspective view of a MEMS assembly with barrier over port according to various embodiments of the present invention.
Figure 19:
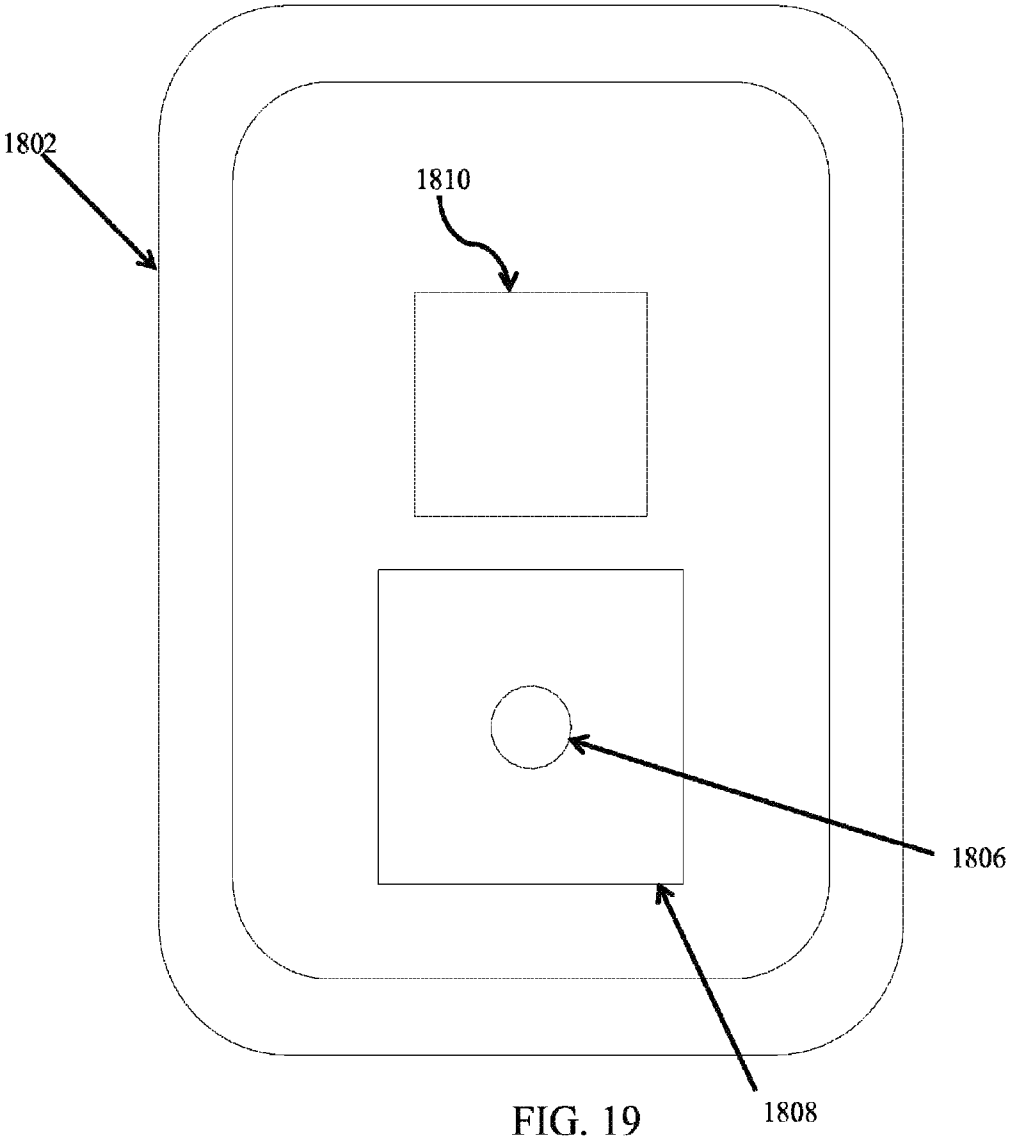
FIG. 19 comprises a top view of the base portion of the assembly of FIG. 18 according to various embodiments of the present invention.
Figure 20:
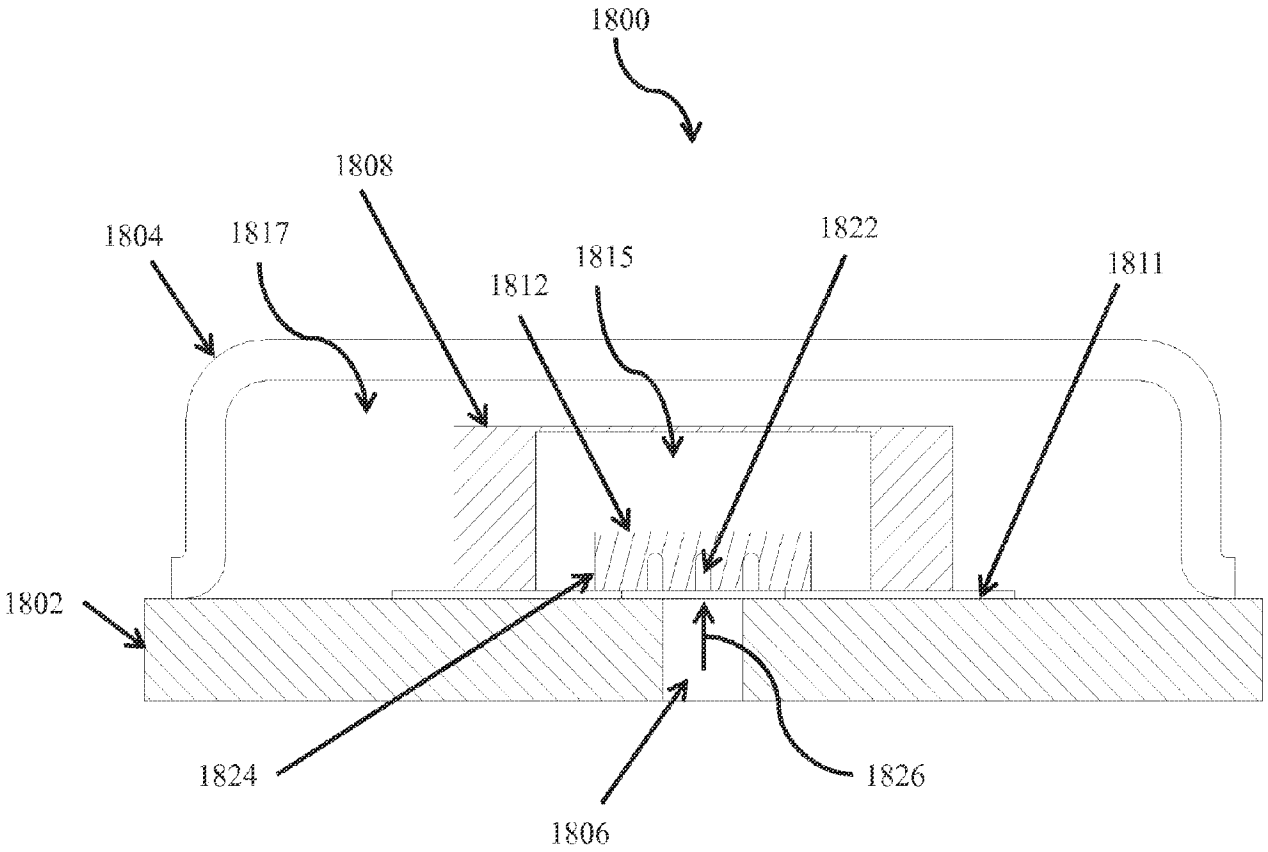
FIG. 20 comprises a cross-sectional perspective view taken along line G-G of the barrier of FIGS. 18 and 19 according to various embodiments of the present invention.

Referring now to FIGS. 18-20, another example of a MEMS assembly 1800 having a tortuous path for acoustic energy that provides protection for particulate infiltration is described. The assembly 1800 includes a base 1802, a lid 1804, a port 1806, a Microelectromechanical System (MEMS) apparatus 1808, a barrier 1812, and an integrated circuit 1810.

Generally speaking and as described elsewhere herein, each of the lid 1804 and base 1802 are formed of one or more layers of materials. For example, these components may be constructed of FR-4 boards and may have various conductive and insulating layers arranged around these boards.

The port 1806 extends through the base 1802 and the MEMS apparatus 1808 extends across the port. Conductive traces (not shown) couple the output of the integrated circuit 1810 to conductive pads 1816 on the base. A customer can make an electrical connection with these pads for further processing of the signal that is received from the integrated circuit 1810.

The MEMS apparatus 1808 receives acoustic energy which is transduced into electrical energy. In that respect, the MEMS apparatus 1808 may include a diaphragm and a back plate. Acoustic energy causes movement of the diaphragm and this varies the voltage between the diaphragm and the back plate. The resulting electrical signal that is produced represents the acoustic energy that has been received by the MEMS apparatus 1808. The MEMS apparatus 1808 is attached to the base by die attach adhesive 1811 or any other appropriate fastening mechanism or approach.

The integrated circuit 1810 is any kind of integrated circuit that performs any kind of processing function. In one example, the integrated circuit 1810 is a buffer or an amplifier. Other examples of integrated circuits are possible. Although only one integrated circuit is shown in this example, it will be appreciated that multiple integrated circuits may be deployed.

The barrier 1812 is in one aspect a silicon piece that extends across and over the port 1806 and within (under) the MEMS apparatus 1808. The barrier 1812 has a first trench 1822 and a second trench 1824. A sound path 1826 is shown for sound. The trenches 1822 and 1824 are etched in silicone in an intersecting pattern. So, as air hits the bottom of the silicone barrier 1812 it exits out the side.

The trenches 1822 and 1824 can be created, for example, by dry etching approaches. The long path created acts as a particle filter. The barrier 1812 is in the front volume 1815 and not the back volume 1817. This disposition of the barrier 1812 beneath the MEMS apparatus 1808 may improve the acoustic performance of the assembly 1800 by decreasing the front volume that otherwise would be present.

The barrier 1812 can have a wide variety of dimensions. In one illustrative example, the barrier 1812 is approximately 0.5 mm wide by approximately 0.5 mm long by approximately 0.15 mm thick. When used in top port devices, the same material may provide an acoustic resistance that is used to flatten the frequency response of the top port device.

Figure 21:
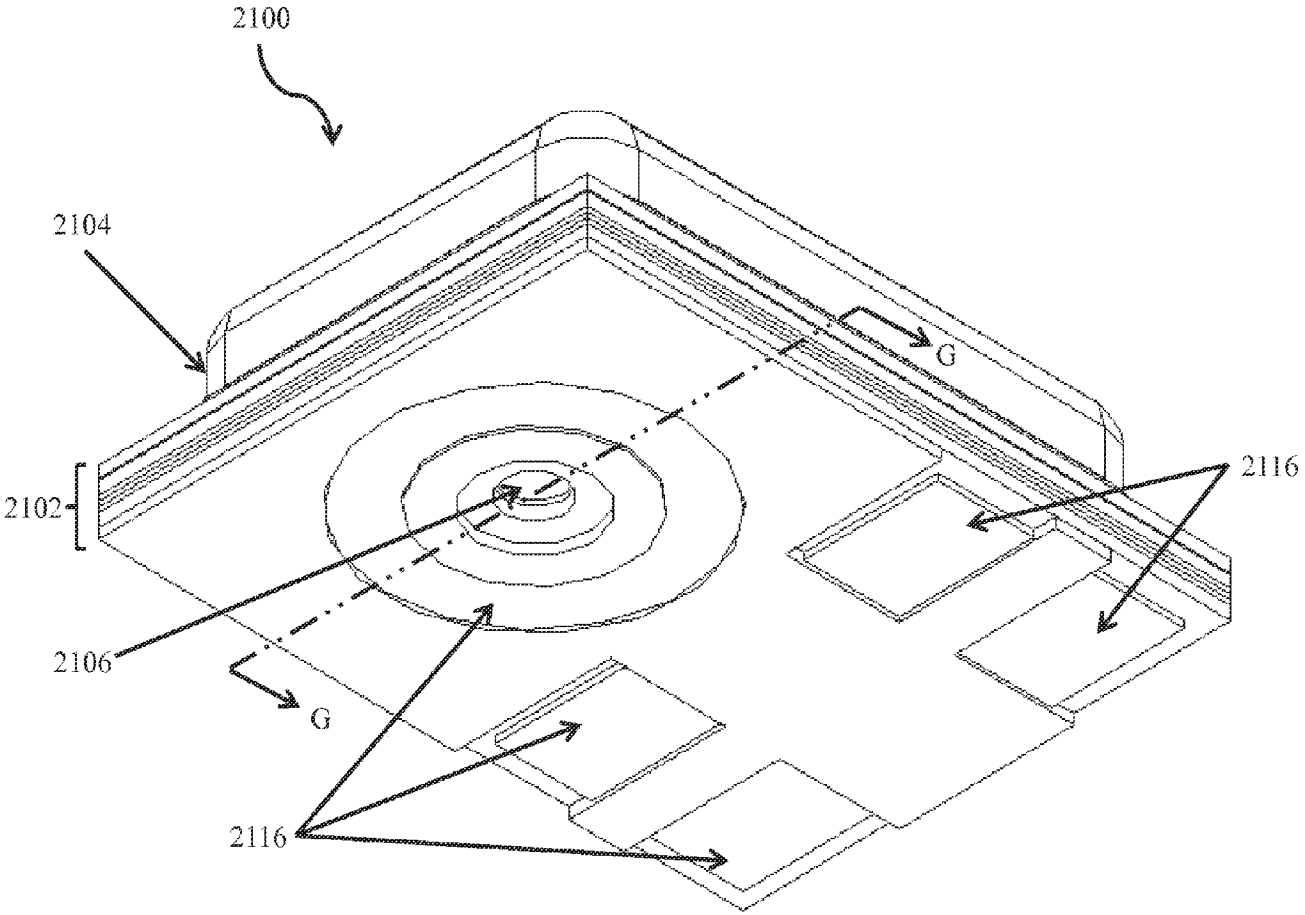
FIG. 21 comprises a perspective view of a MEMS assembly with barrier over port according to various embodiments of the present invention.
Figure 22:
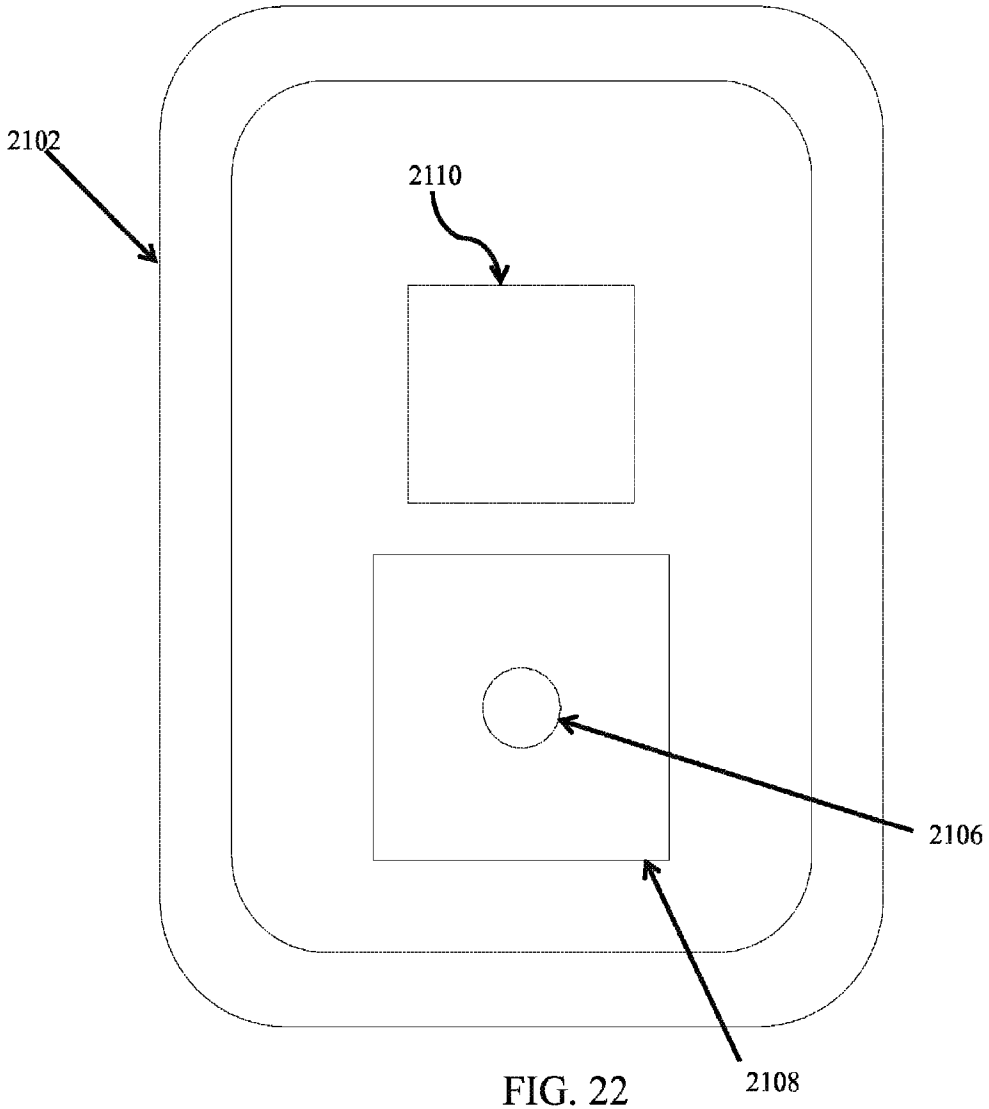
FIG. 22 comprises a top view of the base portion of the assembly of FIG. 21 according to various embodiments of the present invention.
Figure 23:
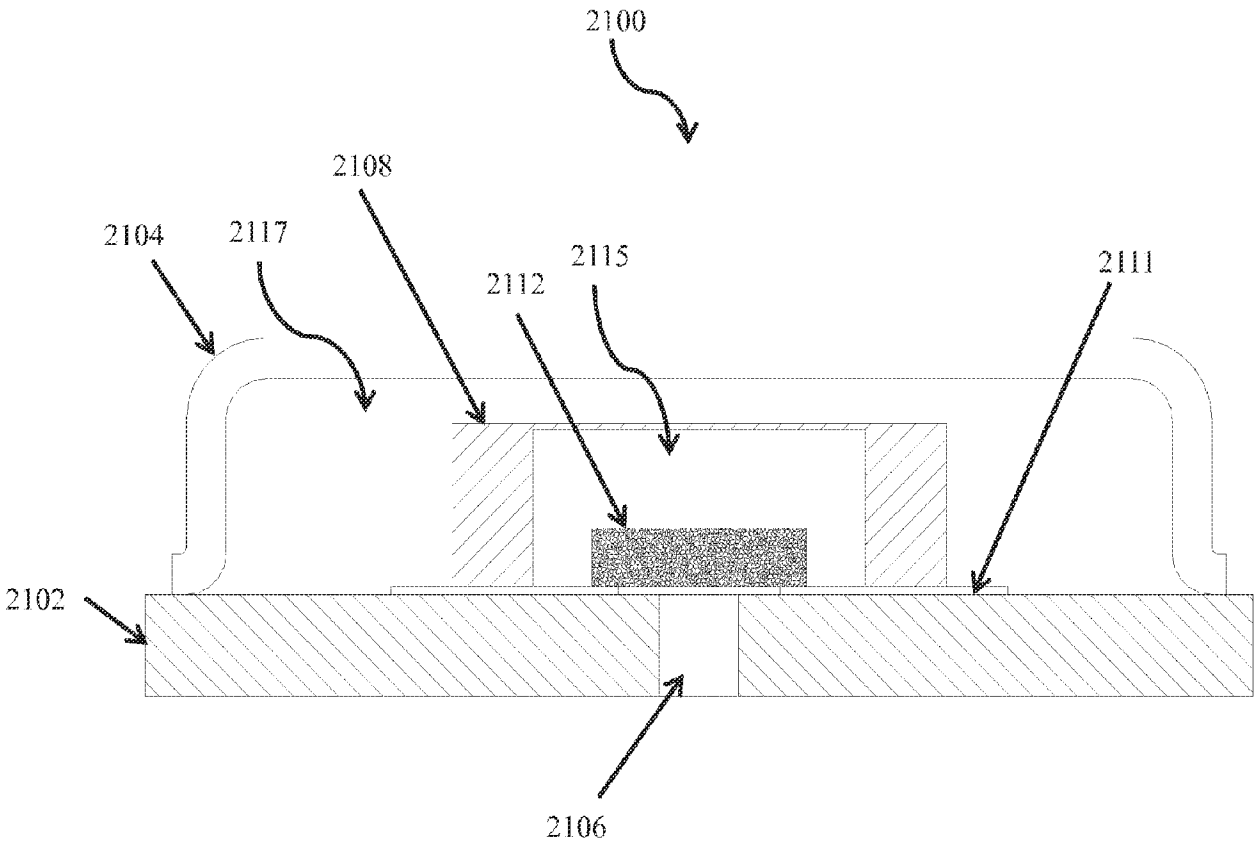
FIG. 23 comprises a cross-sectional perspective view taken along line H-H of the barrier of FIGS. 21 and 22 according to various embodiments of the present invention.

Referring now to FIGS. 21-23, another example of a MEMS assembly 2100 having a tortuous path barrier path for acoustic energy is described. The assembly 2100 includes a base 2102, a lid 2104, a port 2106, a Microelectromechanical System (MEMS) apparatus 2108, a barrier 2112, and an integrated circuit 2110.

Generally speaking and as described elsewhere herein, each of the lid 2104 and base 2102 are formed of one or more layers of materials. For example, these components may be constructed of FR-4 boards and may have various conductive and insulating layers arranged around these boards.

The port 2106 extends through the base 2102 and the MEMS apparatus 2108 extends across the port. Conductive traces (not shown) couple the output of the integrated circuit 2110 to conductive pads 2116 on the base. A customer can make an electrical connection with these pads 2116 for further processing of the signal that is received from the integrated circuit 2110.

The MEMS apparatus 2108 receives acoustic energy and converts the acoustic energy into electrical energy. In that respect, the MEMS apparatus 2108 may include a diaphragm and a back plate. Acoustic energy causes movement of the diaphragm and this varies the voltage between the diaphragm and the back plate. The resulting electrical signal that is produced represents the acoustic energy that has been received by the MEMS apparatus 2108. The MEMS apparatus 2108 is attached to the base by die attach adhesive 2111 or any other appropriate fastening mechanism or approach.

The integrated circuit 2110 is any kind of integrated circuit that performs any kind of processing function. In one example, the integrated circuit 2110 is a buffer or an amplifier. Other examples of integrated circuits are possible. Although only one integrated circuit is shown in this example, it will be appreciated that multiple integrated circuits may be deployed.

In one aspect, the barrier 2112 is a piece of porous ceramic material with approximately 1-100 micrometer pore sizes or more preferably 2-20 micrometer pore sizes that are effective as a particle filter. In other words, sound can pass through the pores, but larger particulates are prevented from passing. The barrier 2112 can have a wide variety of dimensions. In one illustrative example, the barrier 2112 is approximately 0.5 mm long by approximately 0.5 mm wide by approximately 0.25 mm thick placed under the MEMS apparatus 2108 in the cavity over the port 2106. It will be appreciated that the barrier 2112 is in the front volume 2115 and not the back volume 2117. This disposition of the barrier 2112 beneath the MEMS apparatus 2108 may improve the acoustic performance of the assembly 2100 by decreasing the front volume that would otherwise be present.

In one example, a thin impervious layer constructed, for example, from sprayed on lacquer or stamp transferred adhesive that is added to the upper surface of the barrier 2112 so that a vacuum can handle the pieces as it provides a sealing surface which vacuum tooling can latch onto. The thin impervious layer is advantageously viscous during application so not to wick into the porous ceramic.

Figure 24:
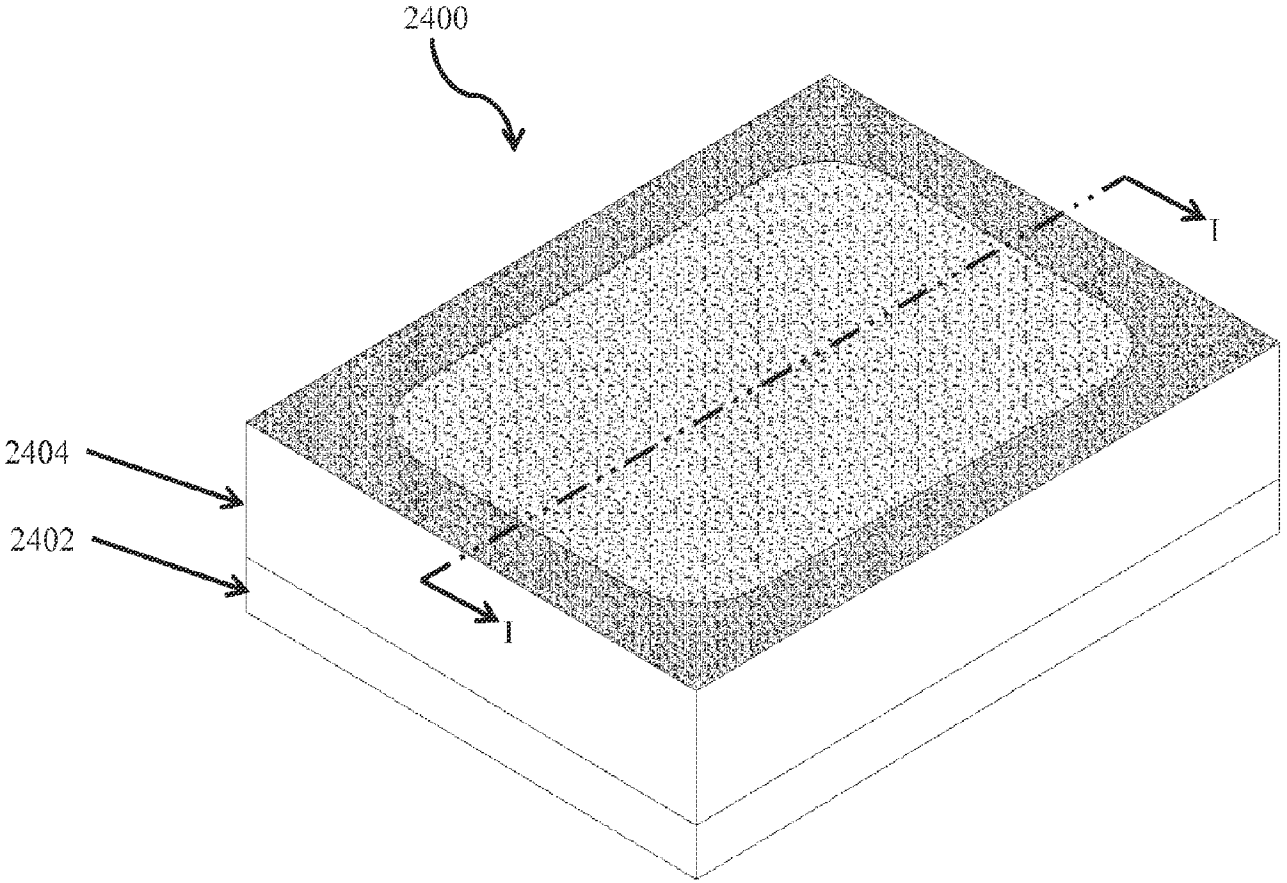
FIG. 24 comprises a perspective view of a MEMS assembly with barrier without a port according to various embodiments of the present invention.
Figure 25:
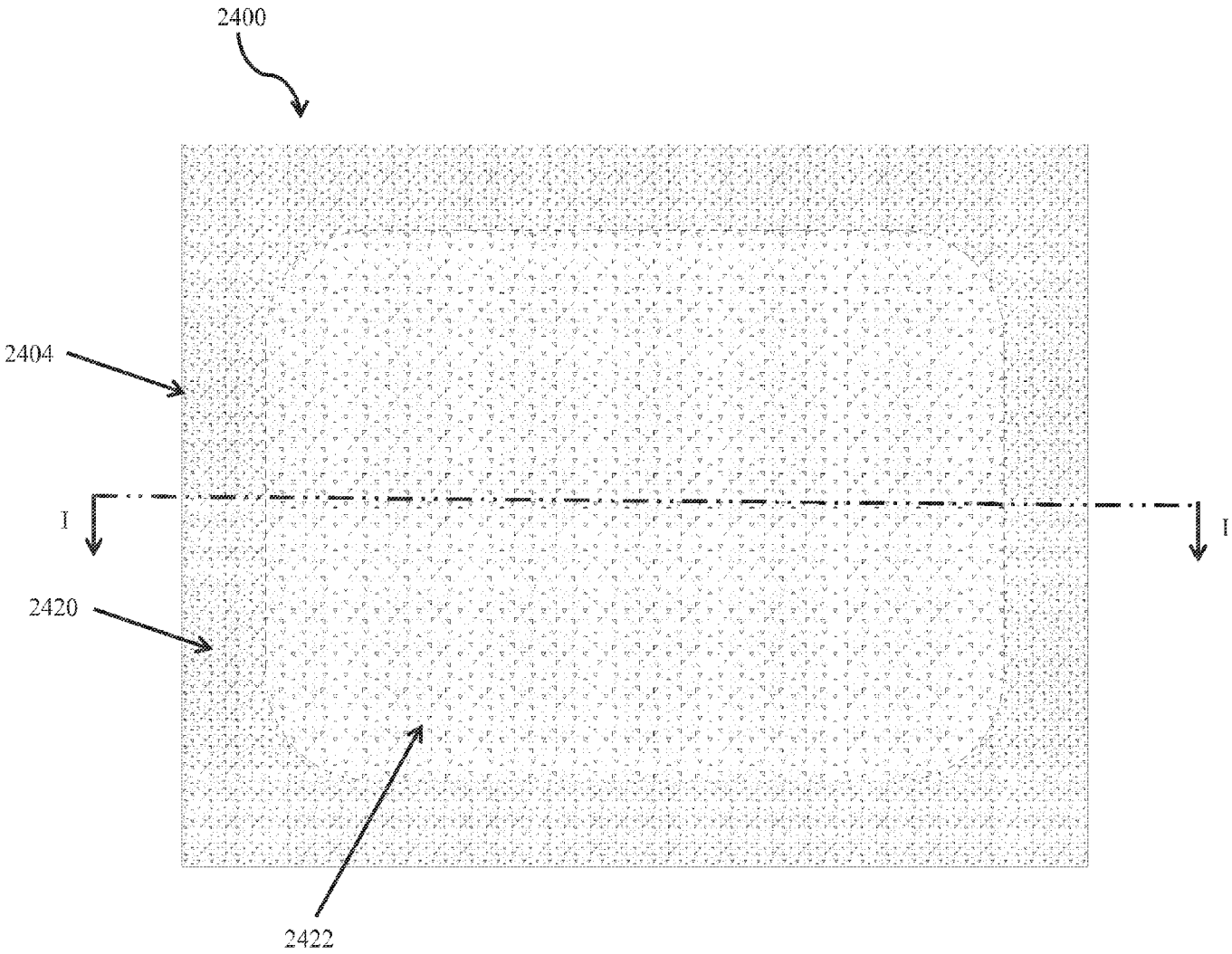
FIG. 25 comprises a top view of the base portion of the lid of FIG. 24 according to various embodiments of the present invention.
Figure 26:
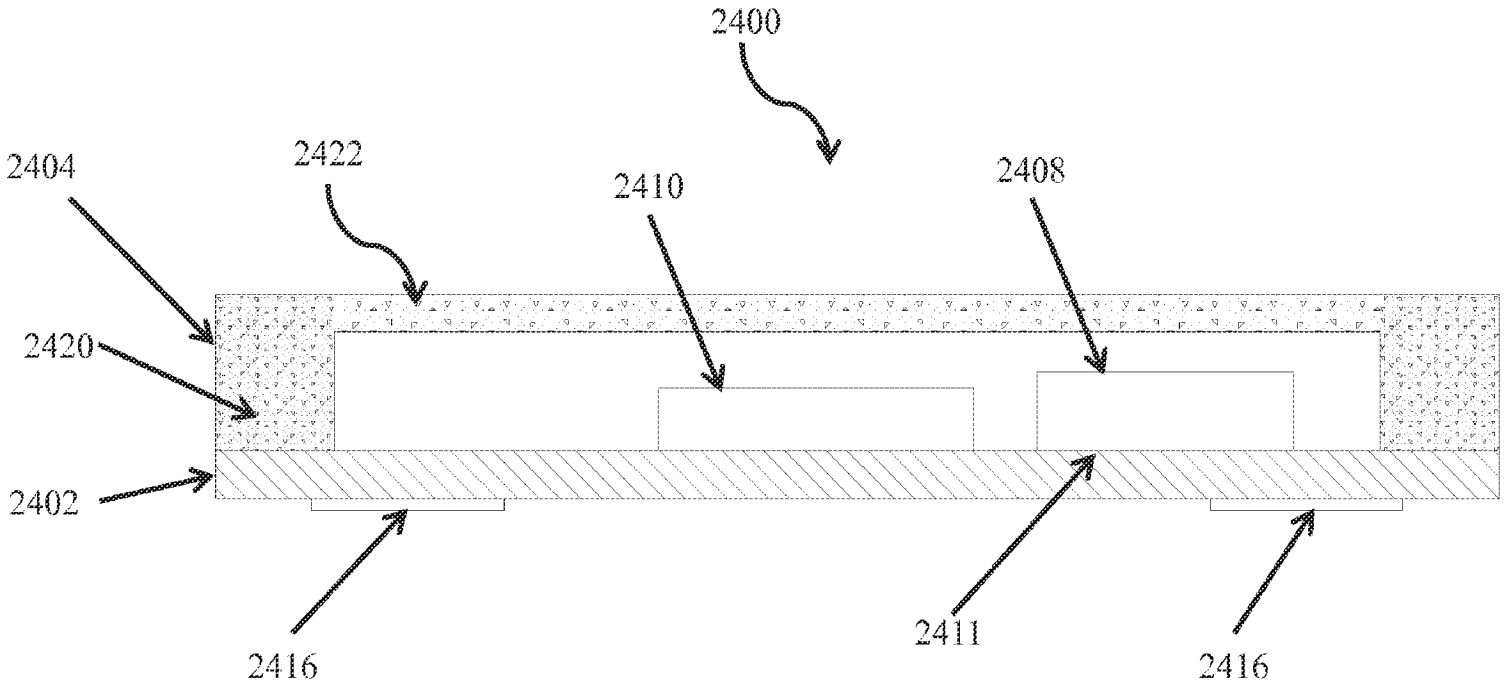
FIG. 26 comprises a cross-sectional perspective view taken along line I-I of the barrier of FIGS. 24 and 25 according to various embodiments of the present invention.

Referring now to FIGS. 24-26, another example of an assembly 2400 that utilizes a particulate filter or barrier is described. The assembly 2400 includes a base 2402, a lid 2404, a Microelectromechanical System (MEMS) apparatus 2408, and an integrated circuit 2410. There is no dedicated port. Instead, sound enters through the portion of the lid 2422 (which is porous) into the MEMS apparatus 2408. The structure of the lid 2404 is described in greater detail below.

Generally speaking and as described elsewhere herein, each of the lid 2404 and base 2402 are formed of one or more layers of materials. For example, these components may be constructed of FR-4 boards and may have various conductive and insulating layers arranged around these boards or ceramics or metals Conductive traces (not shown) couple the output of the integrated circuit 2410 to conductive pads 2416 on the base. A customer can make an electrical connection with these pads 2416 for further processing of the signal that is received from the integrated circuit 2410.

The MEMS apparatus 2408 receives acoustic energy and transduces it into electrical energy. In that respect, the MEMS apparatus 2408 may include a diaphragm and a back plate. Acoustic energy causes movement of the diaphragm and this varies the voltage between the diaphragm and the back plate. The resulting electrical signal that is produced represents the acoustic energy that has been received by the MEMS apparatus 2408. The MEMS apparatus 2408 is attached to the base by die attach adhesive 2411 or any other appropriate fastening mechanism or approach.

The integrated circuit 2410 is any kind of integrated circuit that performs any kind of processing function. In one example, the integrated circuit 2410 is a buffer or an amplifier. Other examples of integrated circuits are possible. Although only one integrated circuit is shown in this example, it will be appreciated that multiple integrated circuits may be deployed.

The lid 2404 includes a fused portion 2420 and a partially fused portion 2422. The fused portion 2420 includes a sealing surface 2426 that provides an acoustic seal with the base 2402. The partially fused portion 2422 provides an acoustic portion. That is, the partially fused portion 2422 allows sound to pass but prevents particulates from entering. By "fused," it is meant the media is melted to the point of complete coalescence containing no voids. By "partially fused," it is meant that the media is melted to the point of partial coalescence containing voids. The partially fused (or sintered) structure provides a tortuous path making debris and liquid ingress into the interior of the assembly difficult or impossible.

It will be appreciated that the porosity of the material used to construct the lid 2402 can be modified to flatten (via dampening) the frequency response of the microphone assembly. The lid 2402 can be constructed of metal to provide protection against radio frequency interference (RFI). As mentioned, it will be appreciated that this approach does not include a port hole or opening that necessarily extends entirely through either the base or the lid; rather, this approach includes a porous, tortuous path for entry of sound into the assembly. In addition, the lid 2402 can be coated with a hydrophobic coating to increase its resistance to liquid water penetration.

Figure 27:
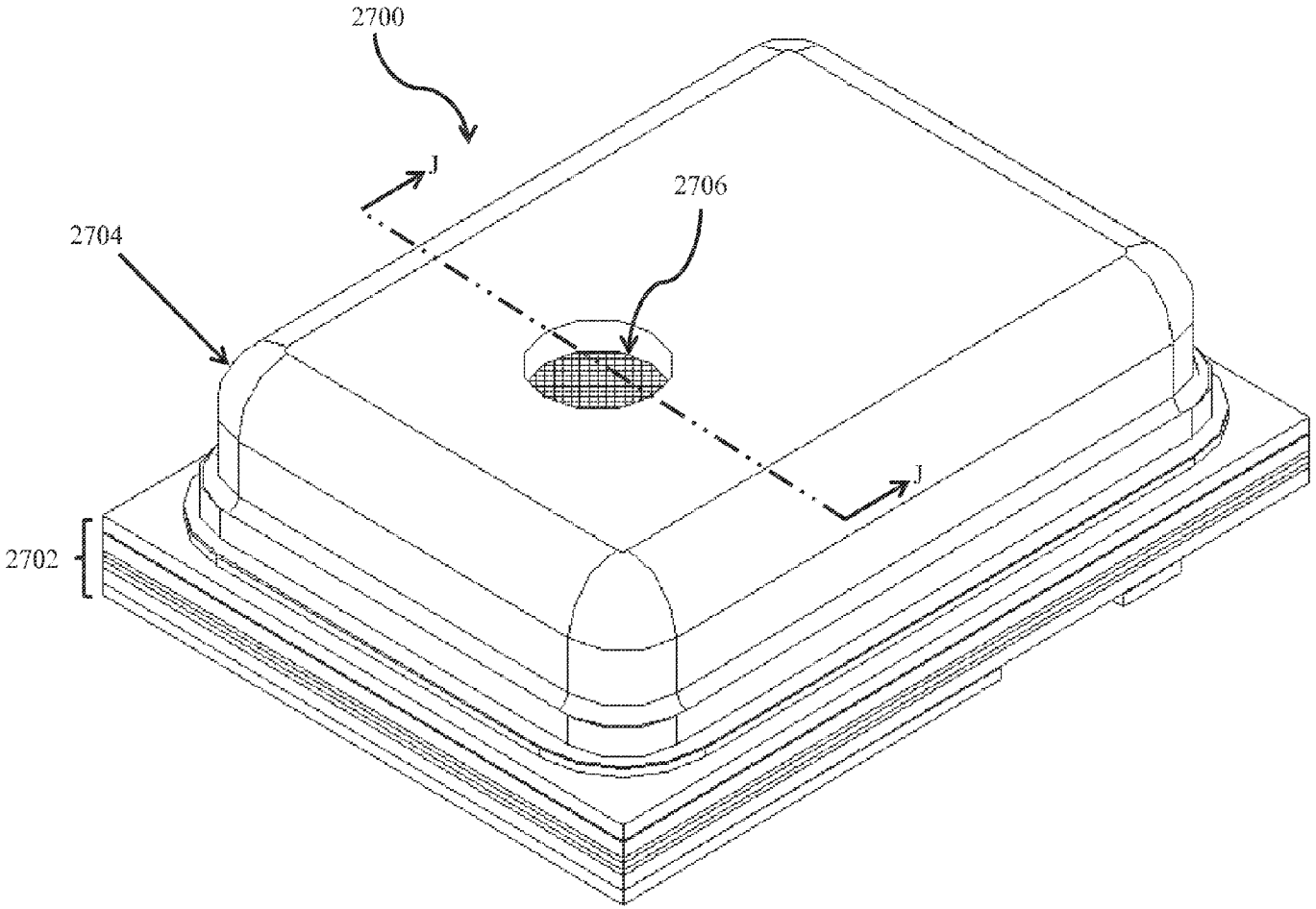
FIG. 27 comprises a perspective view of a MEMS assembly with barrier without a port according to various embodiments of the present invention.
Figure 28:
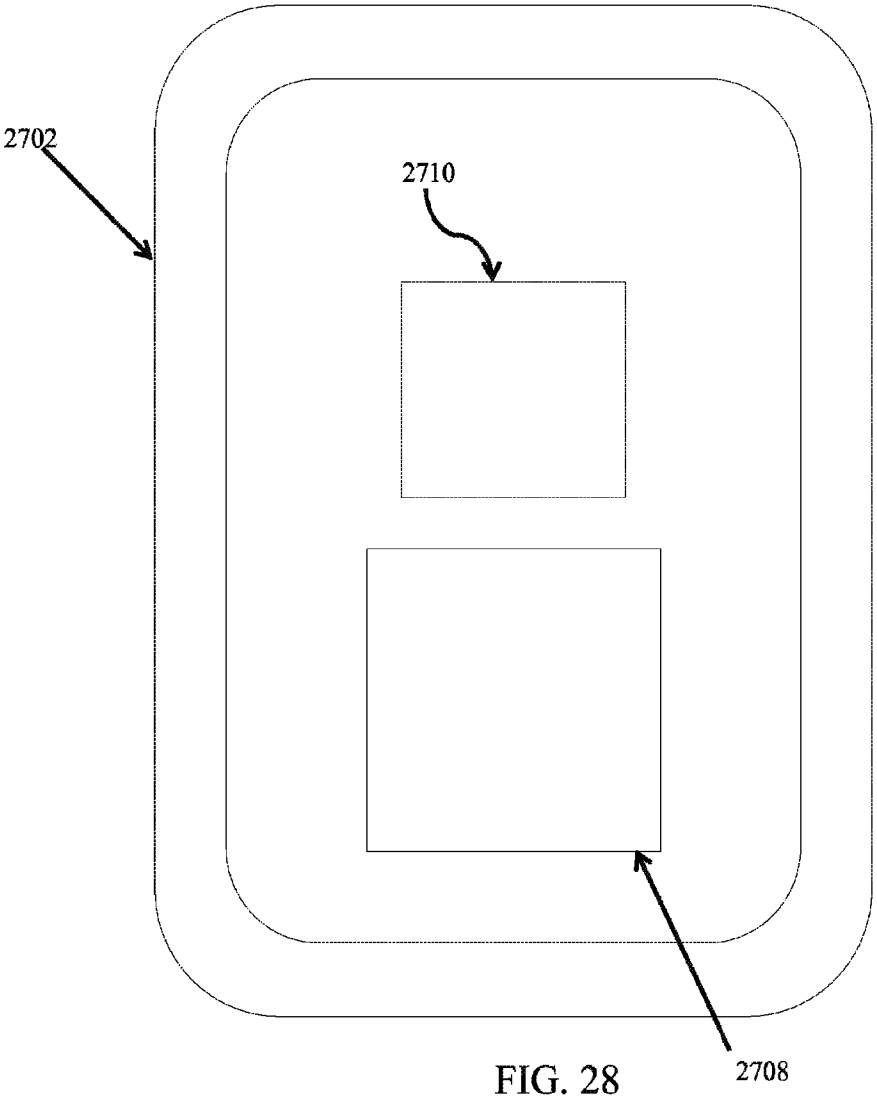
FIG. 28 comprises a top view of the base portion of the assembly of FIG. 27 according to various embodiments of the present invention.
Figure 29:
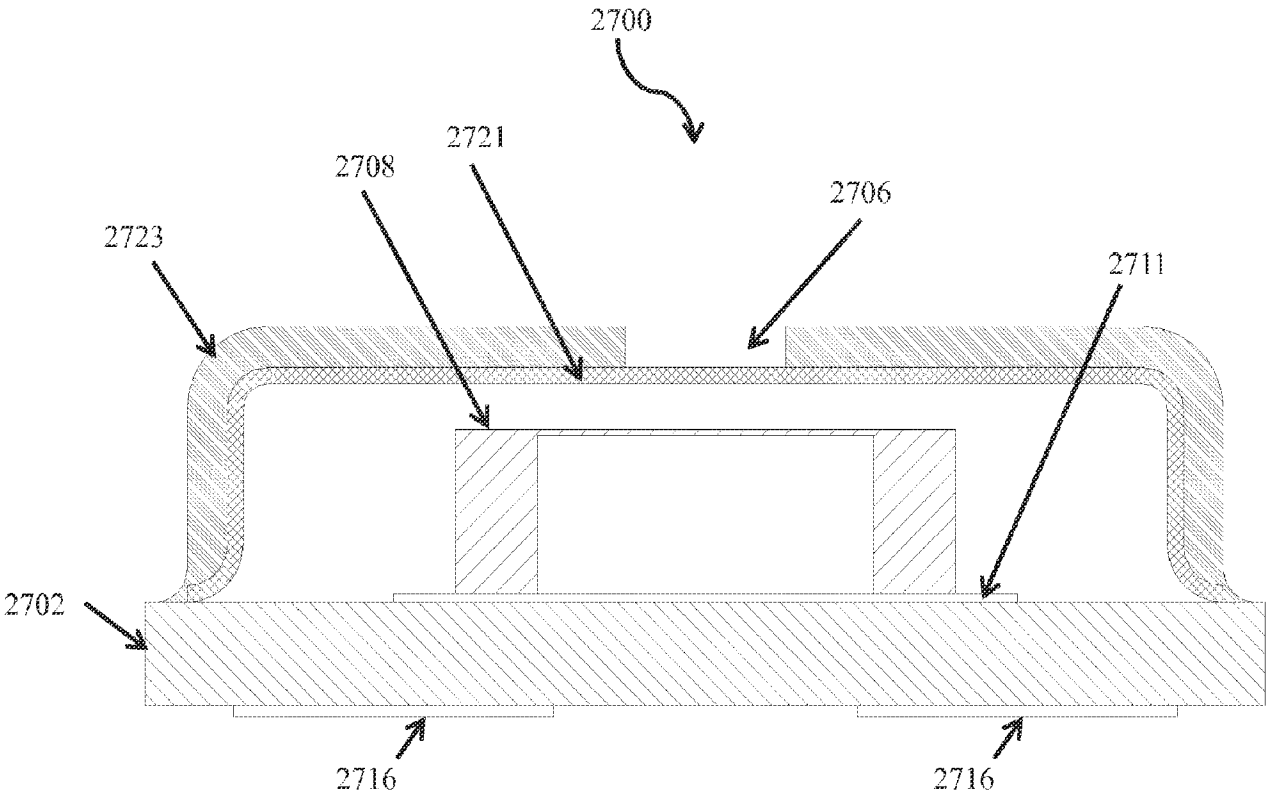
FIG. 29 comprises a cross-sectional perspective view taken along line J-J of the barrier of FIGS. 27 and 28 according to various embodiments of the present invention.

Referring now to FIGS. 27-29, another example of an assembly 2700 that utilizes a particulate filter or barrier is described. The assembly 2700 includes a base 2702, a lid 2704, a Microelectromechanical System (MEMS) apparatus 2708, and an integrated circuit 2710. Sound enters through the lid 2702 via a port 2706 into the MEMS apparatus 2708. The structure of the lid 2704 is described in greater detail below.

Generally speaking and as described elsewhere herein, each of the lid 2704 and base 2702 are formed of one or more layers of materials. For example, these components may be constructed of FR-4 boards and may have various conductive and insulating layers arranged around these boards.

Conductive traces (not shown) couple the output of the integrated circuit 2710 to conductive pads 2716 on the base. A customer can make an electrical connection with the pads 2716 for further processing of the signal that is received from the integrated circuit 2710.

The MEMS apparatus 2708 receives acoustic energy and transduces it into electrical energy. In that respect, the MEMS apparatus 2708 may include a diaphragm and a back plate. Sound energy causes movement of the diaphragm and this varies the charge between the diaphragm and the back plate. The resulting electrical signal that is produced represents the sound energy that has been received by the MEMS apparatus 2708. The MEMS apparatus 2708 is attached to the base by die attach adhesive 2711 or any other appropriate fastening mechanism or approach.

The integrated circuit 2710 is any kind of integrated circuit that performs any kind of processing function. In one example, the integrated circuit 2710 is a buffer or an amplifier. Other examples of integrated circuits are possible. Although only one integrated circuit is shown in this example, it will be appreciated that multiple integrated circuits may be deployed.

The lid 2704 is constructed from mesh metal 2721. The mesh metal 2721 is optionally covered with an epoxy 2723 (or some similar material) and allowed to harden to obtain a solid part. During manufacturing, the mask (or portion) of the epoxy 2723 that actually covers the port hole is selectively patterned or etched away leaving a mesh-covered port 2706 or opening and a solid lid. In some aspects, the mesh 2721 functions as a faraday cage, thereby providing radio frequency (RF) protection to the components of the assembly 2700. Enhanced RF protection may also be provided over previous approaches due to the port being covered by mesh. Particle ingress protection is provided by small (e.g., approximately 50 um or less) holes or openings in the mesh that defines the port hole 2706. It will be appreciated that the lid 2704 may be constructed completely with a mesh (it covers the entire lid) or partially with mesh (e.g., the mesh is utilized only at the top of the lid 2704). The metal mesh 2721 can also be coated with hydrophobic material to increase its resistance to liquid water penetration.

Figure 30:
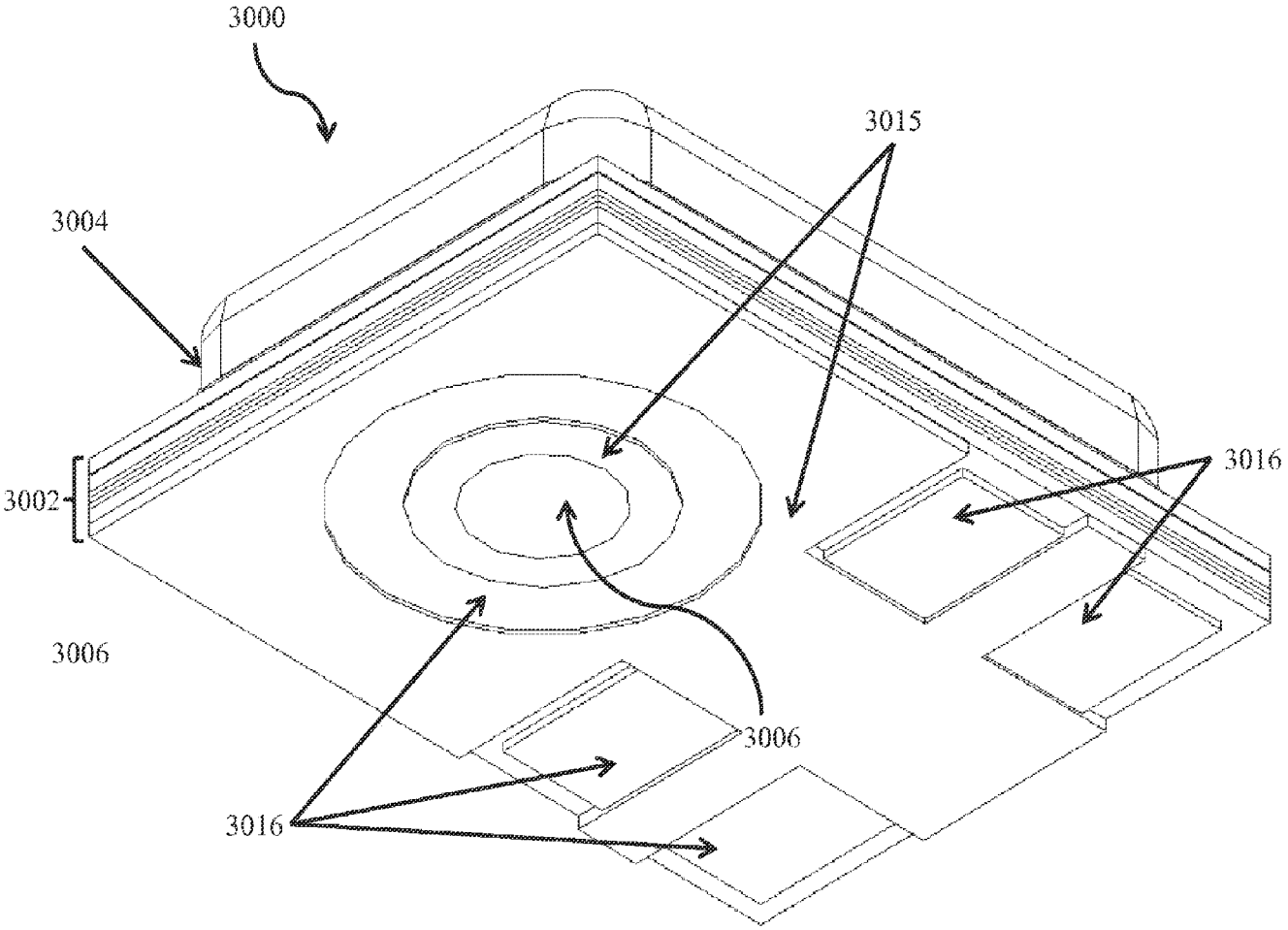
FIG. 30 comprises a perspective view of a MEMS assembly with barrier without a port according to various embodiments of the present invention.
Figure 31:
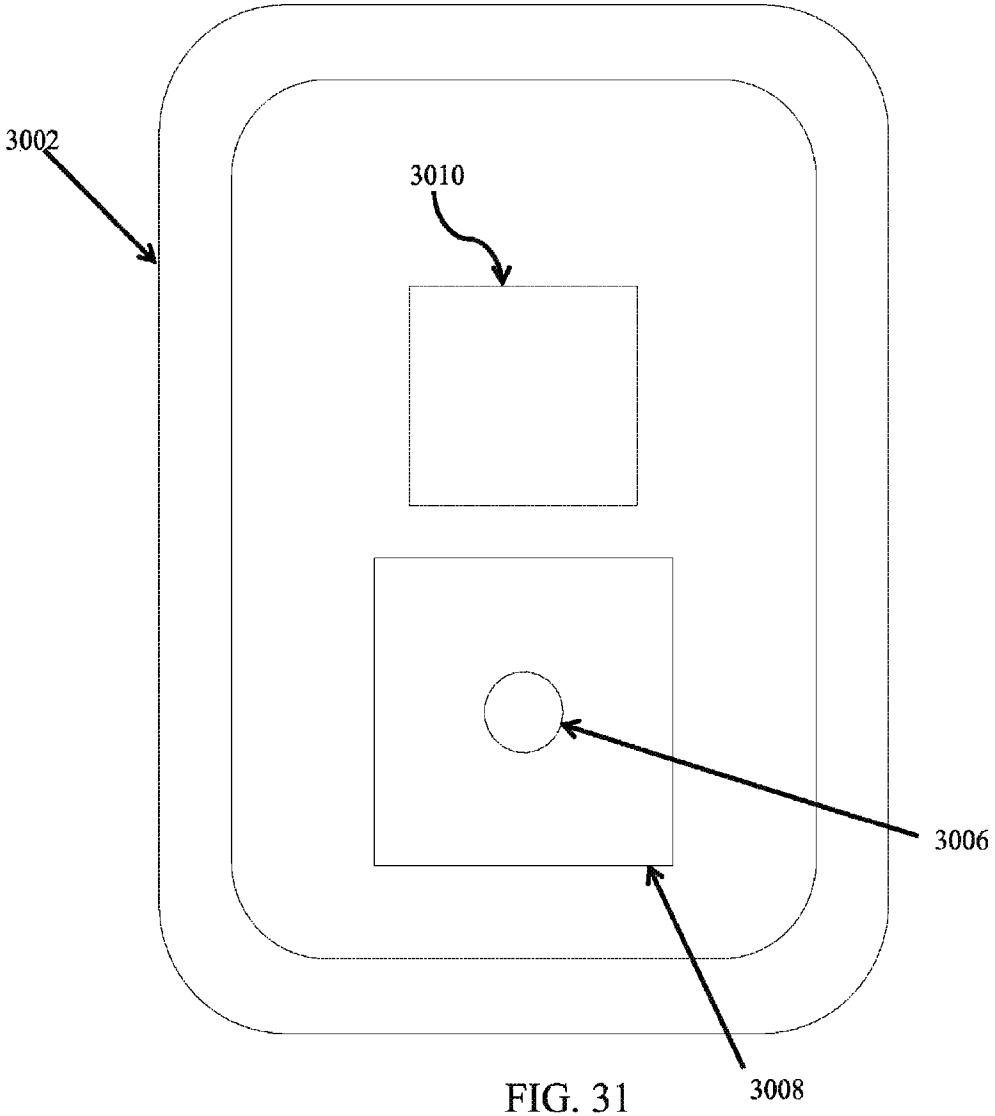
FIG. 31 comprises a top view of the base portion of the assembly of FIG. 27 according to various embodiments of the present invention.
Figure 32:
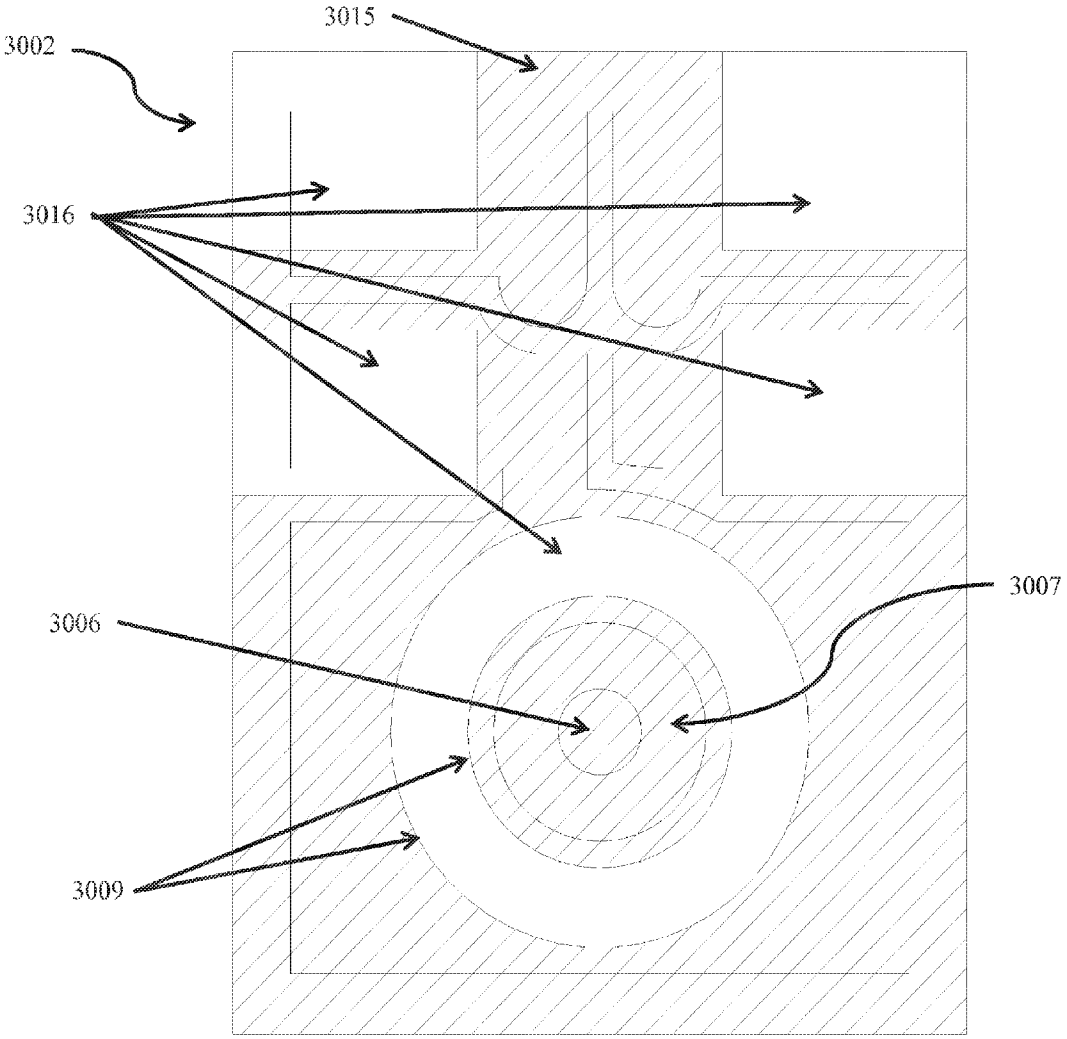
FIG. 32 comprises a bottom view of the barrier of FIGS. 30 and 31 according to various embodiments of the present invention.

Referring now to FIGS. 30-32, an example of a microphone assembly that uses a passivation or membrane layer is described. The assembly 3000 includes a base 3002 (with the passivation layer 3020), a lid 3004, a Microelectromechanical System (MEMS) apparatus 3008, and an integrated circuit 3010, and a port 3006. The structure of the base 3002 is described in greater detail below.

Generally speaking and as described elsewhere herein, each of the lid 3004 and base 3002 are formed of one or more layers of materials. For example, these components may be constructed of FR-4 boards and may have various conductive and insulating layers arranged around these boards.

Conductive traces (not shown) couple the output of the integrated circuit 3010 to conductive pads 3016 on the base. A customer can make an electrical connection with the pads 3016 for further processing of the signal that is received from the integrated circuit 3010.

The MEMS apparatus 3008 receives acoustic energy which is transduced into electrical energy. In that respect, the MEMS apparatus 3008 may include a diaphragm and a back plate. Acoustic energy causes movement of the diaphragm and this varies the charge between the diaphragm and the back plate. The resulting electrical signal that is produced represents the acoustic energy that has been received by the MEMS apparatus 3008. The MEMS apparatus 3008 is attached to the base by die attach adhesive (not shown) or any other appropriate fastening mechanism or approach.

The integrated circuit 3010 is any kind of integrated circuit that performs any kind of processing function. In one example, the integrated circuit 3010 is a buffer or an amplifier. Other examples of integrated circuits are possible. Although only one integrated circuit is shown in this example, it will be appreciated that multiple integrated circuits may be deployed.

The passivation or membrane layer 3015 replaces the solder mask layer of bottom port microphone assemblies. The layer 3015, for example, is a mechanically attached (e.g., using ultrasonic welding) insulating porous membrane (e.g., ePTFE) as the layer. The layer acts as a passivation layer to prevent solder flow between solder pads 3016 (which are defined by the ultrasonic weld/cut edge 3009). The layer 3015 provides protection against ingress foreign materials, both liquid and solid particulates, into the acoustic port since it covers the acoustic port 3006. The end result is a welded pattern film of porous polymer with openings for the solder pad but covering the port 3006 in the area 3007 that is not ultrasonically welded.

Figure 33:
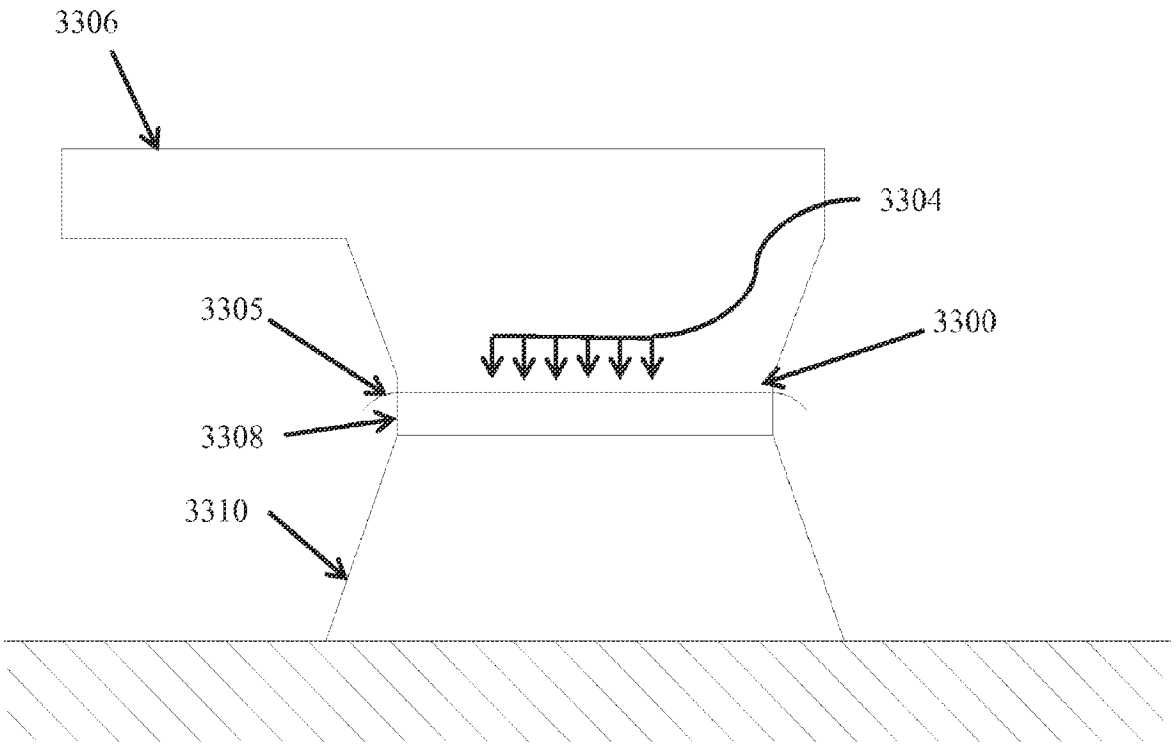
FIG. 33 comprises a drawing of a manufacturing approach for the assemblies of FIGS. 30-32 according to the present invention.

Referring now to FIG. 33, one example of an approach to manufacturing the devices of FIGS. 30-32 is described. A PCB panel 3300 includes an array of one or more microphone bases 3304. A porous polymer membrane 3305 is applied over the panel 3300. The PCB panel 3302 is disposed between a horn 3306 and tooling 3308 and the tooling 3308 rests on an anvil 3310. The function of the horn 3306 is to provide ultrasonic energy. The function of the tooling 3308 is to provide surfaces that weld and cut the porous membrane. The anvil 3310 supports the tooling 3308 to allow transfer of acoustic energy from the horn 3306.

Ultrasonic energy and pressure is applied to the horn 3306 and the horn 3306 transfers energy through the PCB panel 3300 causing the tooling 3308 to weld and simultaneously cut the porous polymer membrane 3305 to the panel 3300. In other words the tool 3308 cuts out/removes areas for solder pads but covers the port area. It will be appreciated that other manufacturing methods can also be employed.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A micro-electro-mechanical system (MEMS) microphone, the microphone comprising:

a rectangular substrate comprising:

a rigid base layer comprised of multiple sub-layers of non-conductive material, wherein the base layer has a planar top surface and a planar bottom surface, the top surface having an interior region and an attachment region, the attachment region disposed between the interior region and the edges of the base layer, and completely bounding the interior region;

a first metal layer disposed on the top surface of the base layer and defined by a first solder mask layer;

a second metal layer disposed on the bottom surface of the base layer and defined by a second solder mask layer into a plurality of flat conductive pads, the second plurality of flat conductive pads arranged to be within a perimeter of the bottom surface of the base layer;

one or more electrical pathways disposed completely within the base layer;

an acoustic port disposed in the interior region of the base layer and passing completely through the base layer, wherein the acoustic port is disposed in a position offset from a centerpoint of the substrate, and wherein one of the plurality of conductive pads is a metal ring that completely surrounds the acoustic port in the base layer and has an inner diameter that is greater than the diameter of the acoustic port; and a patterned flexible printed circuit board material sandwiched between the sub-layers of the base layer, the flexible printed circuit board material having openings that substantially block contaminants from passing through the acoustic port;

a MEMS microphone die mounted to the top surface of the substrate, the MEMS microphone die being disposed directly over the acoustic port in the base layer, wherein the one or more electrical pathways electrically couple the MEMS microphone die to the plurality of conductive pads on the bottom surface of the base layer; and a solid single-piece rectangular cover having a predetermined shape, the rectangular cover comprising a top portion and a substantially vertical and continuous sidewall portion that adjoins the top portion at an angle and that completely surrounds and supports the top portion, the sidewall portion having a predetermined height, an exterior sidewall surface, an interior sidewall surface, and an attachment surface, wherein the attachment surface of the sidewall portion of the cover is aligned with and attached to the attachment region of the top surface of the base layer of the substrate, wherein the attachment surface of the sidewall portion is in contact with the first metal layer; and wherein the predetermined height of the sidewall portion of the cover, the interior sidewall surface of the sidewall portion of the cover, and the interior surface of the top portion of the cover, in cooperation with the interior region of the top surface of the base layer, defines an acoustic chamber for the MEMS microphone die.

2. A MEMS microphone according to claim 1, wherein the patterned flexible printed circuit board material is a polyimide material with multiple geometric openings that allow air to pass through while substantially blocking contaminants.

3. A MEMS microphone according to claim 1, wherein the patterned flexible printed circuit board material has a hydrophobic coating.

4. A MEMS microphone according to claim 1, wherein one or more sub-layers of the base layer comprise FR-4 printed circuit board material.

5. A MEMS microphone according to claim 4, wherein copper-clad metal layers are interposed between the sub-layers of FR-4 printed circuit board material.

6. A MEMS microphone according to claim 5, wherein the substrate further comprises a dielectric material that is different from the sub-layers of non-conductive material in the base layer of the substrate, the dielectric material layer being sandwiched between the copper-clad metal layers of the base layer.

7. A MEMS microphone according to claim 1, wherein the MEMS microphone further comprises one or more integrated circuits mounted to the top surface of the substrate and electrically coupled to the MEMS microphone die.

8. A micro-electro-mechanical system (MEMS) microphone, the microphone comprising:

a rectangular substrate comprising:

a rigid base layer comprised of multiple sub-layers of non-conductive material, wherein the base layer has a planar top surface and a planar bottom surface, the top surface having an interior region and an attachment region, the attachment region disposed between the interior region and the edges of the base layer, and completely bounding the interior region;

a first metal layer disposed on the top surface of the base layer and defined by a first solder mask layer;

a second metal layer disposed on the bottom surface of the base layer and defined by a second solder mask layer into a plurality of flat conductive pads, the second plurality of flat conductive pads arranged to be within a perimeter of the bottom surface of the base layer;

one or more electrical pathways disposed completely within the base layer;

an acoustic port disposed in the interior region of the base layer and passing completely through the base layer, wherein the acoustic port is disposed in a position offset from a centerpoint of the substrate, and wherein one of the plurality of conductive pads is a metal ring that completely surrounds the acoustic port in the base layer and has an inner diameter that is greater than the diameter of the acoustic port; and a plurality of porous membrane layers sandwiched together between the sub-layers of the base layer, the plurality of porous membrane layers having openings that substantially block contaminants from passing through the acoustic port;

a MEMS microphone die mounted to the top surface of the substrate, the MEMS microphone die being disposed directly over the acoustic port in the base layer, wherein the one or more electrical pathways electrically couple the MEMS microphone die to the plurality of conductive pads on the bottom surface of the base layer; and a solid single-piece rectangular cover having a predetermined shape, the rectangular cover comprising a top portion and a substantially vertical and continuous sidewall portion that adjoins the top portion at an angle and that completely surrounds and supports the top portion, the sidewall portion having a predetermined height, an exterior sidewall surface, an interior sidewall surface, and an attachment surface, wherein the attachment surface of the sidewall portion of the cover is aligned with and attached to the attachment region of the top surface of the base layer of the substrate, wherein the attachment surface of the sidewall portion is in contact with the first metal layer; and wherein the predetermined height of the sidewall portion of the cover, the interior sidewall surface of the sidewall portion of the cover, and the interior surface of the top portion of the cover, in cooperation with the interior region of the top surface of the base layer, defines an acoustic chamber for the MEMS microphone die.

9. A MEMS microphone according to claim 8, wherein one or more sub-layers of the base layer comprise FR-4 printed circuit board material.

10. A MEMS microphone according to claim 9, wherein copper-clad metal layers are interposed between the sub-layers of FR-4 printed circuit board material.

11. A MEMS microphone according to claim 10, wherein the substrate further comprises a dielectric material that is different from the sub-layers of non-conductive material in the base layer of the substrate, the dielectric material layer being sandwiched between the copper-clad metal layers of the base layer.

12. A MEMS microphone according to claim 8, wherein the MEMS microphone further comprises one or more integrated circuits mounted to the top surface of the substrate and electrically coupled to the MEMS microphone die.

13. A micro-electro-mechanical system (MEMS) microphone, the microphone comprising:

a rectangular substrate comprising:

a rigid base layer comprised of multiple sub-layers of non-conductive material, wherein the base layer has a planar top surface and a planar bottom surface, the top surface having an interior region and an attachment region, the attachment region disposed between the interior region and the edges of the base layer, and completely bounding the interior region;

a first metal layer disposed on the top surface of the base layer and defined by a first solder mask layer;

a second metal layer disposed on the bottom surface of the base layer and defined by a second solder mask layer into a plurality of flat conductive pads, the second plurality of flat conductive pads arranged to be within a perimeter of the bottom surface of the base layer;

one or more electrical pathways disposed completely within the base layer;

an acoustic port disposed in the interior region of the base layer and passing completely through the base layer, wherein the acoustic port is disposed in a position offset from a centerpoint of the substrate, and wherein one of the plurality of conductive pads is a metal ring that completely surrounds the acoustic port in the base layer and has an inner diameter that is greater than the diameter of the acoustic port; and a plurality of porous mesh layers sandwiched together between the sub-layers of the base layer, the plurality of porous mesh layers having openings that substantially block contaminants from passing through the acoustic port;

a MEMS microphone die mounted to the top surface of the substrate, the MEMS microphone die being disposed directly over the acoustic port in the base layer, wherein the one or more electrical pathways electrically couple the MEMS microphone die to the plurality of conductive pads on the bottom surface of the base layer; and a solid single-piece rectangular cover having a predetermined shape, the rectangular cover comprising a top portion and a substantially vertical and continuous sidewall portion that adjoins the top portion at an angle and that completely surrounds and supports the top portion, the sidewall portion having a predetermined height, an exterior sidewall surface, an interior sidewall surface, and an attachment surface, wherein the attachment surface of the sidewall portion of the cover is aligned with and attached to the attachment region of the top surface of the base layer of the substrate, wherein the attachment surface of the sidewall portion is in contact with the first metal layer; and wherein the predetermined height of the sidewall portion of the cover, the interior sidewall surface of the sidewall portion of the cover, and the interior surface of the top portion of the cover, in cooperation with the interior region of the top surface of the base layer, defines an acoustic chamber for the MEMS microphone die.

14. A MEMS microphone according to claim 13, wherein one or more sub-layers of the base layer comprise FR-4 printed circuit board material.

15. A MEMS microphone according to claim 14, wherein copper-clad metal layers are interposed between the sub-layers of FR-4 printed circuit board material.

16. A MEMS microphone according to claim 15, wherein the substrate further comprises a dielectric material that is different from the sub-layers of non-conductive material in the base layer of the substrate, the dielectric material layer being sandwiched between the copper-clad metal layers of the base layer.

17. A MEMS microphone according to claim 13, wherein the MEMS microphone further comprises one or more integrated circuits mounted to the top surface of the substrate and electrically coupled to the MEMS microphone die.

18. A MEMS microphone according to claim 13, wherein the plurality of porous mesh layers comprise woven fabric.

19. A MEMS microphone according to claim 13, wherein the plurality of porous mesh layers comprise metal mesh.

20. A MEMS microphone according to claim 13, wherein the plurality of porous mesh layers comprise porous filter material.

* * * * *